US012501930B2

(12) United States Patent
Grishchenko

(10) Patent No.: US 12,501,930 B2
(45) Date of Patent: Dec. 23, 2025

(54) NON-COMBUSTIBLE AEROSOL PROVISION SYSTEM

(71) Applicant: Nicoventures Trading Limited, London (GB)

(72) Inventor: Andrei Grishchenko, London (GB)

(73) Assignee: NICOVENTURES TRADING LIMITED, London (GB)

( * ) Notice: Subject to any disclaimer, the term of this patent is extended or adjusted under 35 U.S.C. 154(b) by 586 days.

(21) Appl. No.: 17/785,280

(22) PCT Filed: Dec. 21, 2020

(86) PCT No.: PCT/GB2020/053337

§ 371 (c)(1),
(2) Date: Jun. 14, 2022

(87) PCT Pub. No.: WO2021/123842

PCT Pub. Date: Jun. 24, 2021

(65) Prior Publication Data

US 2023/0043185 A1 Feb. 9, 2023

(30) Foreign Application Priority Data

Dec. 20, 2019 (GB) ..... 1919103
Oct. 12, 2020 (GB) ..... 2016142

(51) Int. Cl.
*A24F 40/30* (2020.01)
*A24F 40/465* (2020.01)
*A24F 40/57* (2020.01)

(52) U.S. Cl.
CPC ..... *A24F 40/30* (2020.01); *A24F 40/465* (2020.01); *A24F 40/57* (2020.01)

(58) Field of Classification Search
CPC ..... A24F 40/30; A24F 40/465; A24F 40/57
See application file for complete search history.

(56) References Cited

U.S. PATENT DOCUMENTS

2013/0074853 A1* 3/2013 Sebastian ..... B29C 55/30 131/334
2020/0245675 A1* 8/2020 Dimmick ..... A24D 3/061
2020/0397035 A1* 12/2020 Lee ..... A24F 40/465

FOREIGN PATENT DOCUMENTS

CN 109497618 A 3/2019
WO 2013068081 A1 5/2013
(Continued)

OTHER PUBLICATIONS

Russian Office Action for corresponding application 2022 02098; Report dated Jan. 23, 2024.
(Continued)

*Primary Examiner* — Michael H. Wilson
*Assistant Examiner* — Jennifer A Kessie
(74) *Attorney, Agent, or Firm* — CANTOR COLBURN LLP

(57) ABSTRACT

The present disclosure relates to a non-combustible aerosol provision system comprising an aerosol modifying component, an aerosol generating material and a heater which, in use, is operable to heat the aerosol generating material such that the aerosol generating material provides an aerosol. The aerosol modifying component is downstream of the aerosol generating material and comprises first and second capsules. The first capsule is in a first portion of the aerosol modifying component, wherein the first portion of the aerosol modifying component is heated to a first temperature during operation of the heater to generate the aerosol. The second capsule is in a second portion of the aerosol modifying component located downstream of the first portion, wherein the second portion is heated to a second temperature during operation of the heater to generate aerosol, and wherein the second temperature is at least 4 degrees Celsius lower than the first temperature.

20 Claims, 7 Drawing Sheets

(56) References Cited

FOREIGN PATENT DOCUMENTS

| | | | |
|---|---|---|---|
| WO | 2017207586 | A1 | 12/2017 |
| WO | 2019081905 | A1 | 5/2019 |
| WO | 2019105950 | A1 | 6/2019 |
| WO | 2019166640 | A1 | 9/2019 |

OTHER PUBLICATIONS

International Search Report for corresponding application PCT/GB2020/053337 filed Dec. 21, 2020; Mail date Mar. 19, 2021.
Written Opinion for corresponding application PCT/GB2020/053337 filed Dec. 21, 2020; Mail date Mar. 19, 2021.
Korean Office action for corresponding application 10-2022-7020906; Dated Nov. 12, 2024.

* cited by examiner

NON-COMBUSTIBLE AEROSOL PROVISION SYSTEM

TECHNICAL FIELD

The present disclosure relates to a non-combustible aerosol provision system.

BACKGROUND

Certain tobacco industry products produce an aerosol during use, which is inhaled by a user. For example, tobacco heating devices heat an aerosol generating substrate such as tobacco to form an aerosol by heating, but not burning, the substrate. Such tobacco industry products commonly include mouthpieces through which the aerosol passes to reach the user's mouth.

SUMMARY

In accordance with some embodiments described herein, there is provided a non-combustible aerosol provision system comprising an aerosol modifying component, an aerosol generating material and a heater which, in use, is operable to heat the aerosol generating material such that the aerosol generating material provides an aerosol, wherein the aerosol modifying component is downstream of the aerosol generating material and comprises: a first capsule in a first portion of the aerosol modifying component, wherein the first portion of the aerosol modifying component is heated to a first temperature during operation of the heater to generate the aerosol; and, a second capsule in a second portion of the aerosol modifying component located downstream of the first portion, wherein the second portion is heated to a second temperature during operation of the heater to generate aerosol, and wherein the second temperature is at least 4 degrees Celsius lower than the first temperature.

In some embodiments, the second temperature is at least 5 degrees Celsius lower than the first temperature and, preferably, at least 6 degrees Celsius, at least 7 degrees Celsius, or at least 8 degrees Celsius lower than the first temperature.

In some embodiments, the first and/or second capsule has a diameter in the range of 1 to 5 mm and, preferably, in the range of 2 to 4 mm.

In some embodiments, the first and second capsules are spaced apart by a distance of at least 7 mm and, preferably at least 8 mm.

In some embodiments, the first and/or second capsule is disposed in a fibrous material and, preferably, in cellulose acetate.

In some embodiments, the density of material is in the range of 0.1 to 0.2 gms/cm3.

In some embodiments, the first and second capsules are aerosol-modifying agent capsules having different aerosol-modifying profiles.

In some embodiments, the first and second capsules comprise different aerosol-modifying agents and/or a different amount of an aerosol-modifying agent.

In some embodiments, the first and second capsules comprise different amounts of an aerosol-modifying agent.

In some embodiments, the or each aerosol-modifying agent comprises a flavourant.

In some embodiments, the second capsule comprises an aerosol-modifying agent that has a higher vapour pressure than the aerosol-modifying agent of the first capsule.

In some embodiments, the first and second capsules are aerosol-modifying agent capsules having the same aerosol-modifying profiles.

In some embodiments, the first and second capsules comprise the same aerosol-modifying agent and the same amount of aerosol-modifying agent.

In some embodiments, the aerosol modifying component comprises a body of material and wherein the first and second capsules are located in the body of material.

In some embodiments, the body of material is a continuous section of material.

In some embodiments, the body of material comprises a tow.

In some embodiments, the tow has a denier per filament of at least 5 and, preferably, at least 6, at least 7 or at least 8.

In some embodiments, the tow has a denier per filament of 14 or less and, preferably, 13 or less, 12 or less, 11 or less, 10 or less, or, 9 or less.

In some embodiments, the tow has a total denier of at most 30000 and preferably, at most 28000, at most 25000, at most 23000, at most 22000 or at most 21000.

In some embodiments, the tow has a total denier of at least 8000 and preferably, at least 10000, at least 12000, at least 15000, at least 17000, at least 19000, at least 20000, or at least 21000.

In some embodiments, the tow of the body of material has a weight of at least 20 mg and, preferably, at least 25 mg, 30 mg, 35 mg, 40 mg, 45 mg, 50 mg, 55 mg or 60 mg.

In some embodiments, the tow of the body of material has a weight of at most 100 mg and, preferably, at most 95 mg, 90 mg, 85 mg, 80 mg, 75 mg, 70 mg or 65 mg.

In some embodiments, the tow of the body of material has a weight in the range of 20 to 100 mg and, preferably, in the range of 30 to 90 mg, 40 to 80 mg, 50 to 70 mg or 55 to 65 mg.

In some embodiments, the tow of the body of material has a weight of about 60 mg.

In some embodiments, the axial length of the body material is about 20 mm.

In some embodiments, the average weight of the tow of the of the body of material per mm axial length of the body of material is at least 1 mg/mm and, preferably, at least 1.25 mg/mm, 1.5 mg/mm, 1.75 mg/mm, 2 mg/mm, 2.25 mg/mm, 2.5 mg/mm, 2.75 mg/mm or 3 mg/mm.

In some embodiments, the average weight of the tow of the of the body of material per mm axial length of the body of material is at most 5 mg/mm and, preferably, at most 4.75 mg/mm, 4.5 mg/mm, 4.25 mg/mm, 4 mg/mm, 3.75 mg/mm, 3.5 mg/mm or 3.25 mg/mm.

In some embodiments, the average weight of the tow of the of the body of material per mm axial length of the body of material is in the range of 1 to 5 mg/mm and, preferably, in the range of 1.5 to 4.5 mg/mm, 2 to 4 mg/mm, 2.5 to 3.5 mg/mm or 2.75 to 3.25 mg/mm.

In some embodiments, the average weight of the tow of the body of material per mm axial length of the body of material is about 3 mg/mm.

In some embodiments, the body of material comprises plasticiser.

In some embodiments, the body of material may comprise at least 3 mg of plasticiser and, preferably, at least 3.5 mg, 4 mg, 4.5 mg, 5 mg, 5.5 mg, 6 mg, 6.5 mg 7 mg, 7.5 mg, 7.6 mg or 7.7 mg of plasticiser.

In some embodiments, the body of material may comprise at most 12 mg of plasticiser and, preferably, at most 11.5 mg, 11 mg, 10.5 mg, 10 mg, 9.5 mg, 9 mg, 8.5 mg, 8 mg, 7.9 mg or 7.8 mg of plasticiser.

In some embodiments, the body of material comprises in the range of 3 to 12 mg of plasticiser and, preferably, in the range of 5 to 10 mg, 6 to 9 mg, or 7 to 8 mg of plasticiser.

In some embodiments, the body of material comprises about 7.7 mg of plasticiser.

In some embodiments, the total weight of the body of material (including the tow and plasticiser), the first and second aerosol release components, the first plug wrap that circumscribes the body of material and the adhesive that secures the first plug wrap in position, is at least 40 mg and, preferably, at least 50 mg, 60 mg, 70 mg, 80 mg, 90 mg, 100 mg, 110 mg, 115 mg or 120 mg.

In some embodiments, the total weight of the body of material (including the tow and plasticiser), the first and second aerosol release components, the first plug wrap that circumscribes the body of material and the adhesive that secures the first plug wrap in position is at most 200 mg and, preferably, at most 190 mg, 180 mg, 170 mg, 160 mg, 150 mg, 140 mg, 135 mg, 130 mg or 125 mg. In some embodiments, said total weight is in the range of 40 to 200 mg and, preferably, in the range of 60 to 180 mg, 80 to 160 mg, 100 to 140 mg, 110 to 130 mg or 115 to 125 mg. In some embodiments, said total weight is about 120 mg.

In some embodiments, the body of material has an axial length in the range of 10 to 30 mm and, preferably, in the range of 15 to 25 mm.

In some embodiments, the aerosol modifying component has a hardness in the range of 78% to 93% and, preferably, in the range of 83% to 88% or in the range of 84% to 87%.

In some embodiments, the hardness of the body of material with the first and second capsules therein is in the range 75% to 90% and, preferably, in the range of 80% to 85% or in the range of 81% to 83%.

In some embodiments, the pressure drop across the aerosol modifying component when the first and second capsules are unbroken is at least 15 mmH2O and, preferably, is at least 20, 25, 30, or 35 mmH2O.

In some embodiments, the pressure drop across the aerosol modifying component when the first and second capsules are unbroken is less than 65 mmH2O and, preferably, is less than 60, 55, 50, 45 or 40 mmH2O.

In some embodiments, the non-combustible aerosol provision system is a tobacco heating system.

In some embodiments, the aerosol generating material comprises a first aerosol generating material, and the article further comprises a component downstream of the first aerosol generating material, wherein the component comprises a tubular portion and wherein the tubular portion comprises a wall comprising a second aerosol generating material.

In some embodiments, the aerosol generating material is wrapped by a wrapper having a level of permeability greater than about 2000 Coresta Units, and wherein the article comprises a downstream portion downstream of the aerosol generating material, comprising at least one ventilation area.

In some embodiments, the article is configured such that when the article is inserted into a non-combustible aerosol provision device, the minimum distance between a heater of the non-combustible aerosol provision device and a tubular section of the article is at least about 3 mm.

In some embodiments, the level of ventilation provided by said one or more ventilation holes is within the range of 45% to 75% of the volume of aerosol passing through the component, or between 40% and 70% of the volume of aerosol passing through the component, or between 60% and 70%.

In some embodiments, the non-combustible aerosol provision system comprises a hollow tubular element extending from a mouth end of the article, wherein the hollow tubular element comprises a length of greater than about 10 mm or greater than about 12 mm.

In some embodiments, the fibrous material comprises filamentary tow, the filamentary tow comprising a weight per mm of length of the body of material which is between about 10% and about 30% of the range between the minimum and maximum weights of a tow capability curve generated for the filamentary tow.

In some embodiments, the non-combustible aerosol provision system comprises a downstream portion downstream of the aerosol generating material, wherein the downstream portion comprises a cavity surrounded by a paper tube, and wherein said paper tube has a wall thickness of at least 325 microns and/or a wall with a permeability of at least 100 Coresta Units.

BRIEF DESCRIPTION OF THE DRAWINGS

Embodiments of the invention will now be described, by way of non-limiting example only, with reference to the accompanying drawings, in which.

DETAILED DESCRIPTION

Figure 1:
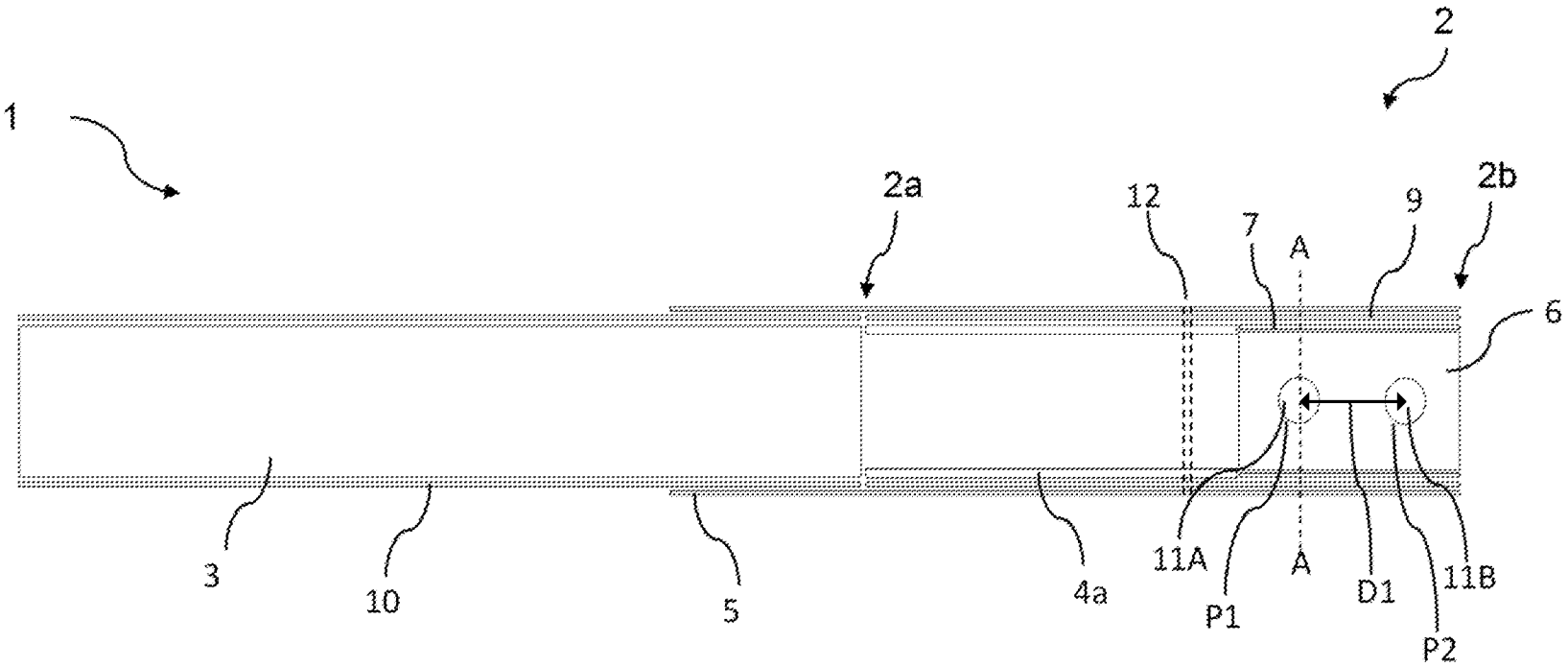
FIG. 1 is a side-on cross sectional view of an article for use with a non-combustible aerosol provision device, the article including a mouthpiece, the mouthpiece including a tubular portion.

According to the present disclosure, a "combustible" aerosol provision system is one where a constituent aerosolisable material of the aerosol provision system (or component thereof) is combusted or burned in order to facilitate delivery to a user.

According to the present disclosure, a "non-combustible" aerosol provision system is one where a constituent aerosol-generating material of the aerosol provision system (or component thereof) is not combusted or burned in order to facilitate delivery of at least one substance to a user.

In some embodiments, the delivery system is a non-combustible aerosol provision system, such as a powered non-combustible aerosol provision system.

In some embodiments, the non-combustible aerosol provision system is an electronic cigarette, also known as a vaping device or electronic nicotine delivery system (END), although it is noted that the presence of nicotine in the aerosol-generating material is not a requirement.

In some embodiments, the non-combustible aerosol provision system is an aerosol-generating material heating system, also known as a heat-not-burn system. An example of such a system is a tobacco heating system.

In some embodiments, the non-combustible aerosol provision system is a hybrid system to generate aerosol using a combination of aerosol-generating materials, one or a plurality of which may be heated. Each of the aerosol-generating materials may be, for example, in the form of a solid, liquid or gel and may or may not contain nicotine. In some embodiments, the hybrid system comprises a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

In some embodiments, the disclosure relates to consumables comprising aerosol-generating material and configured to be used with non-combustible aerosol provision devices. These consumables are sometimes referred to as articles throughout the disclosure.

In some embodiments, the non-combustible aerosol provision system, such as a non-combustible aerosol provision device thereof, may comprise a power source and a controller. The power source may, for example, be an electric power source or an exothermic power source. In some embodiments, the exothermic power source comprises a carbon substrate which may be energised so as to distribute power in the form of heat to an aerosol-generating material or to a heat transfer material in proximity to the exothermic power source.

In some embodiments, the non-combustible aerosol provision system may comprise an area for receiving the consumable, an aerosol generator, an aerosol generation area, a housing, a mouthpiece, a filter and/or an aerosol-modifying agent.

In some embodiments, the consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

In some embodiments, the substance to be delivered comprises an active substance.

The active substance as used herein may be a physiologically active material, which is a material intended to achieve or enhance a physiological response. The active substance may for example be selected from nutraceuticals, nootropics, psychoactives. The active substance may be naturally occurring or synthetically obtained. The active substance may comprise for example nicotine, caffeine, taurine, theine, vitamins such as B6 or B12 or C, melatonin, cannabinoids, or constituents, derivatives, or combinations thereof. The active substance may comprise one or more constituents, derivatives or extracts of tobacco, *Cannabis* or another botanical.

In some embodiments, the active substance comprises nicotine. In some embodiments, the active substance comprises caffeine, melatonin or vitamin B12.

As noted herein, the active substance may comprise one or more constituents, derivatives or extracts of *Cannabis*, such as one or more cannabinoids or terpenes.

As noted herein, the active substance may comprise or be derived from one or more botanicals or constituents, derivatives or extracts thereof. As used herein, the term "botanical" includes any material derived from plants including, but not limited to, extracts, leaves, bark, fibres, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, *Cannabis*, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Memtha longifolia, Mentha suaveolens variegata, Mentha pulegium, Mentha spicata* c.v. and *Mentha suaveolens*

In some embodiments, the active substance comprises or is derived from one or more botanicals or constituents, derivatives or extracts thereof and the botanical is tobacco.

In some embodiments, the active substance comprises or derived from one or more botanicals or constituents, derivatives or extracts thereof and the botanical is selected from eucalyptus, star anise, cocoa and hemp.

In some embodiments, the active substance comprises or derived from one or more botanicals or constituents, derivatives or extracts thereof and the botanical is selected from rooibos and fennel.

In some embodiments, the substance to be delivered comprises a flavour.

As used herein, the terms "flavour" and "flavourant" refer to materials which, where local regulations permit, may be used to create a desired taste, aroma or other somatosensorial sensation in a product for adult consumers. They may include naturally occurring flavour materials, botanicals, extracts of botanicals, synthetically obtained materials, or combinations thereof (e.g., tobacco, *Cannabis*, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some embodiments, the flavour comprises menthol, spearmint and/or peppermint. In some embodiments, the flavour comprises flavour components of cucumber, blueberry, citrus fruits and/or redberry. In some embodiments, the flavour comprises eugenol. In some embodiments, the flavour comprises flavour components extracted from tobacco. In some embodiments, the flavour comprises flavour components extracted from *Cannabis*.

In some embodiments, the flavour may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Aerosol-generating material is a material that is capable of generating aerosol, for example when heated, irradiated or energized in any other way. Aerosol-generating material may, for example, be in the form of a solid, liquid or gel which may or may not contain an active substance and/or flavourants. In some embodiments, the aerosol-generating material may comprise an "amorphous solid", which may alternatively be referred to as a "monolithic solid" (i.e. non-fibrous). In some embodiments, the amorphous solid may be a dried gel. The amorphous solid is a solid material that may retain some fluid, such as liquid, within it. In some embodiments, the aerosol-generating material may for example comprise from about 50 wt %, 60 wt % or 70 wt % of amorphous solid, to about 90 wt %, 95 wt % or 100 wt % of amorphous solid.

The aerosol-generating material may comprise one or more active substances and/or flavours, one or more aerosol-former materials, and optionally one or more other functional material.

The aerosol-former material may comprise one or more constituents capable of forming an aerosol. In some embodiments, the aerosol-former material may comprise one or more of glycerine, glycerol, propylene glycol, diethylene glycol, triethylene glycol, tetraethylene glycol, 1,3-butylene glycol, erythritol, meso-Erythritol, ethyl vanillate, ethyl laurate, a diethyl suberate, triethyl citrate, triacetin, a diacetin mixture, benzyl benzoate, benzyl phenyl acetate, tributyrin, lauryl acetate, lauric acid, myristic acid, and propylene carbonate.

The one or more other functional materials may comprise one or more of pH regulators, colouring agents, preservatives, binders, fillers, stabilizers, and/or antioxidants.

The material may be present on or in a support, to form a substrate. The support may, for example, be or comprise paper, card, paperboard, cardboard, reconstituted material, a plastics material, a ceramic material, a composite material, glass, a metal, or a metal alloy. In some embodiments, the support comprises a susceptor. In some embodiments, the susceptor is embedded within the material. In some alternative embodiments, the susceptor is on one or either side of the material.

A consumable is an article comprising or consisting of aerosol-generating material, part or all of which is intended to be consumed during use by a user. A consumable may comprise one or more other components, such as an aerosol-generating material storage area, an aerosol-generating material transfer component, an aerosol generation area, a housing, a wrapper, a mouthpiece, a filter and/or an aerosol-modifying agent. A consumable may also comprise an aerosol generator, such as a heater, that emits heat to cause the aerosol-generating material to generate aerosol in use. The heater may, for example, comprise combustible material, a material heatable by electrical conduction, or a susceptor.

A susceptor is a material that is heatable by penetration with a varying magnetic field, such as an alternating magnetic field. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor may be both electrically-conductive and magnetic, so that the susceptor is heatable by both heating mechanisms. The device that is configured to generate the varying magnetic field is referred to as a magnetic field generator, herein.

An aerosol-modifying agent is a substance, typically located downstream of the aerosol generation area, that is configured to modify the aerosol generated, for example by changing the taste, flavour, acidity or another characteristic of the aerosol. The aerosol-modifying agent may be provided in an aerosol-modifying agent release component, that is operable to selectively release the aerosol-modifying agent The aerosol-modifying agent may, for example, be an additive or a sorbent. The aerosol-modifying agent may, for example, comprise one or more of a flavourant, a colourant, water, and a carbon adsorbent. The aerosol-modifying agent may, for example, be a solid, a liquid, or a gel. The aerosol-modifying agent may be in powder, thread or granule form. The aerosol-modifying agent may be free from filtration material.

An aerosol generator is an apparatus configured to cause aerosol to be generated from is the aerosol-generating material. In some embodiments, the aerosol generator is a heater configured to subject the aerosol-generating material to heat energy, so as to release one or more volatiles from the aerosol-generating material to form an aerosol. The heater may be an electrically powered heater, for instance, a resistance and/or inductance heater. The electrically powered heater may optionally be powered by a battery. However, the heater may be of an alternative configuration. For instance, the heater may be an exothermic power source and may comprise, for example, a carbon substrate which may be energised so as to distribute power in the form of heat to an aerosol-generating material or to a heat transfer material in proximity to the exothermic power source.

Articles, for instance those in the shape of rods, are often named according to the product length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the product circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm).

Accordingly, an article in a king-size, super-slim format will, for example, have a length of about 83 mm and a circumference of about 17 mm.

Each format may optionally include a mouthpiece. Each format may be produced with mouthpieces of different lengths. The mouthpiece length will be from about 30 mm to 50 mm. A tipping paper connects the mouthpiece to the aerosol generating material and will usually have a greater length than the mouthpiece, for example from 3 to 10 mm longer, such that the tipping paper covers the mouthpiece and overlaps the aerosol generating material, for instance in the form of a rod of substrate material, to connect the mouthpiece to the rod.

Articles and their aerosol generating materials and mouthpieces described herein can be made in, but are not limited to, any of the above formats.

The terms 'upstream' and 'downstream' used herein are relative terms defined in relation to the direction of mainstream aerosol drawn though an article or device in use.

The filamentary tow material described herein can comprise cellulose acetate fibre tow. The filamentary tow can also be formed using other materials used to form fibres, such as polyvinyl alcohol (PVOH), polylactic acid (PLA), polycaprolactone (PCL), poly(1-4 butanediol succinate) (PBS), poly(butylene adipate-co-terephthalate) (PBAT), starch based materials, cotton, aliphatic polyester materials and polysaccharide polymers or a combination thereof. The filamentary tow may be plasticised with a suitable plasticiser for the tow, such as triacetin where the material is cellulose acetate tow, or the tow may be non-plasticised. The tow can have any suitable specification, such as fibres having a 'Y' shaped or other cross section such as 'X' shaped, filamentary denier values between 2.5 and 15 denier per filament, for example between 8.0 and 11.0 denier per filament and total denier values of 5,000 to 50,000, for example between 10,000 and 40,000.

As used herein, the term "tobacco material" refers to any material comprising tobacco or derivatives or substitutes thereof. The term "tobacco material" may include one or more of tobacco, tobacco derivatives, expanded tobacco, reconstituted tobacco or tobacco substitutes. The tobacco material may comprise one or more of ground tobacco, tobacco fibre, cut tobacco, extruded tobacco, tobacco stem, tobacco lamina, reconstituted tobacco and/or tobacco extract.

In the figures described herein, like reference numerals are used to illustrate equivalent features, articles or components.

FIG. 1 is a side-on cross sectional view of an article 1 for use with a non-combustible aerosol provision system.

The article 1 comprises an aerosol-modifying component 2 which, in the present embodiment, is a mouthpiece 2. However, it should be recognised that in alternative embodiments the aerosol-modifying component is not a mouthpiece and, for example, may instead be located upstream of the mouthpiece 2.

The article 1 further comprises a cylindrical rod of aerosol generating material 3, in the present case tobacco material, connected to the mouthpiece 2. The aerosol generating material 3 provides an aerosol when heated, for instance within a non-combustible aerosol provision device as described herein, for instance a non-combustible aerosol provision device comprising a coil, forming a system. In other embodiments the article 1 can include its own heat source, forming an aerosol provision system without requiring a separate aerosol provision device.

The aerosol generating material 3, also referred to herein as an aerosol generating substrate 3, comprises at least one aerosol-former material (contrast with aerosol former-material of the standard definitions). In the present example, the aerosol-former material is glycerol. In alternative examples, the aerosol-former material can be another material as described herein or a combination thereof. The aerosol-former material has been found to improve the sensory performance of the article, by helping to transfer compounds such as flavour compounds from the aerosol generating material to the consumer.

In the present example, the mouthpiece includes a tubular portion 4*a*, in the present example formed by a hollow tube, also referred to as a cooling element. The mouthpiece 2, in the present example, includes a body of material 6 downstream of the tubular portion 4*a*, in this example adjacent to and in an abutting relationship with the tubular portion 4*a*. The body of material 6 and tubular portion 4*a* each define a substantially cylindrical overall outer shape and share a common longitudinal axis.

The body of material 6 is wrapped in a first plug wrap 7. In the present example, the tubular portion 4*a* and body of material 6 are combined using a second plug wrap 9 which is wrapped around both sections. A tipping paper 5 is wrapped around the full length of the mouthpiece 2 and over part of the rod of aerosol generating material 3 and has an adhesive on its inner surface to connect the mouthpiece 2 and rod 3.

In the present example, the tubular portion 4*a* is formed from a plurality of layers of paper which are parallel wound, with butted seams, to form a hollow tube. In the present example, first and second paper layers are provided in a two-ply tube, although in other examples 3, 4 or more paper layers can be used forming 3, 4 or more ply tubes. Other constructions can be used, such as spirally wound layers of paper, cardboard tubes, tubes formed using a papier-mâché type process, moulded or extruded plastic tubes or similar.

The tubular portion 4*a* can also be formed using a stiff plug wrap and/or tipping paper as the second plug wrap 9 and/or tipping paper 5 described herein, meaning that a separate tubular element is not required. The stiff plug wrap and/or tipping paper is manufactured to have a rigidity that is sufficient to withstand the axial compressive forces and bending moments that might arise during manufacture and whilst the article 1 is in use. For instance, the stiff plug wrap and/or tipping paper can have a basis weight between 70 gsm and 120 gsm, more preferably between 80 gsm and 110 gsm. Additionally or alternatively, the stiff plug wrap and/or tipping paper can have a thickness between 80 μm and 200 μm, more preferably between 100 μm and 160 μm, or from 120 μm to 150 μm. It can be desirable for both the second plug wrap 9 and tipping paper 5 to have values in these ranges, to achieve an acceptable overall level of rigidity for the tubular portion 4*a*.

In some embodiments, the tubular portion preferably has a wall thickness of at least about 325 μm and up to about 2 mm, preferably between 500 μm and 1.5 mm and more preferably between 750 μm and 1 mm. In the present example, the tubular portion has a wall thickness of about 1 mm. The "wall thickness" of the tubular portion corresponds to the thickness of the wall of the tubular portion in a radial direction. This may be measured, for example, using a caliper.

In some embodiments, the thickness of the wall of the tubular portion is at least 325 microns and, preferably, at least 400, 500, 600, 700, 800, 900 or 1000 microns. In some embodiments, the thickness of the wall of the tubular portion is at least 1250 or 1500 microns.

In some embodiments, the thickness of the wall of the tubular portion is less than 2000 microns and, preferably, less than 1500 microns.

The increased thickness of the wall of the tubular portion means that it has a greater thermal mass, which has been found to help reduce the temperature of the aerosol passing through the tubular portion and reduce the surface temperature of the mouthpiece at locations downstream of the tubular portion. This is thought to be because the greater thermal mass of the tubular portion allows the tubular portion to absorb more heat from the aerosol in comparison to a tubular portion with a thinner wall thickness. The increased thickness of the tubular portion also channels the aerosol centrally within the mouthpiece such that less heat from the aerosol is transferred to the outer portions of the mouthpiece such as outer portions of the body of material.

In some embodiments, the permeability of the material of the wall of the tubular portion 4*a* is at least 100 Coresta Units and, preferably, at least 500 or 1000 Coresta Units.

It has been found that the relatively high permeability of the tubular portion increases the amount of heat that is transferred to the tubular portion from the aerosol and thus reduces the temperature of the aerosol. The permeability of the tubular portion has also been found to increase the amount of moisture that is transferred from the aerosol to the tubular portion, which has been found to improve the feel of the aerosol in the user's mouth. A high permeability of tubular portion also makes it easier to cut the ventilation holes using a laser, meaning that a lower power of laser can be used.

The article 1 has a ventilation level of about 75% of the aerosol drawn through the article. In alternative embodiments, the article can have a ventilation level of between 50% and 80% of aerosol drawn through the article, for instance between 65% and 75%. Ventilation at these levels helps to slow down the flow of aerosol drawn through the mouthpiece 2 and thereby enable the aerosol to cool sufficiently before it reaches a downstream end 2*b* of the mouthpiece 2. The ventilation is provided directly into the mouthpiece 2 of the article 1. In the present example, the ventilation is provided into the tubular portion 4*a*, which has been found to be particularly beneficial in assisting with the aerosol generation process. The ventilation is provided via first and second parallel rows of ventilation holes 12, in the present case formed as laser perforations, at positions 17.925 mm and 18.625 mm respectively from the downstream, mouth-end 2*b* of the mouthpiece 2. These ventilation holes 12 pass though the tipping paper 5, second plug wrap 9 and tubular portion 4*a*. In alternative embodiments, the ventilation can be provided into the mouthpiece at other locations. For example, the ventilation may be provided into the body of material 6.

Alternatively, the ventilation can be provided via a single row of ventilation holes, for instance laser perforations, into the portion of the article in which the tubular body 4*a* is located. This has been found to result in improved aerosol formation, which is thought to result from the airflow through the ventilation holes being more uniform than with multiple rows of ventilation holes, for a given ventilation level.

Aerosol temperature has been found to generally increase with a drop in the ventilation level. However the relationship between aerosol temperature and ventilation level does not appear to be linear, with variations in ventilation, for instance due to manufacturing tolerances, having less impact at lower target ventilation levels. For instance, with a ventilation tolerance of ±15%, for a target ventilation level of 75%, the aerosol temperature could increase by approximately 6° C. at the lower ventilation limit (60% ventilation). However, with a target ventilation level of 60% the aerosol temperature may only increase by approximately 3.5° C. at the lower vent limit (45% ventilation). The target ventilation level of the article can therefore be within the range 40% to 70%, for instance, 45% to 65%. The mean ventilation level of at least 20 articles can be between 40% and 70%, for instance between 45% and 70% or between 51% and 59%.

In some examples, the aerosol generating material 3 described herein is a first aerosol generating material and the tubular portion 4*a* may include a second aerosol generating material. In one example, wall 4*b* of tubular portion 4*a* comprises the second aerosol generating material. For example, the second aerosol generating material can be disposed on an inner surface of wall 4*b* of the tubular portion 4*a*.

The second aerosol generating material comprises at least one aerosol former material, and may also comprise at least one aerosol modifying agent, or other sensate material.

The aerosol former material and/or aerosol modifying agent can be any aerosol former material or aerosol modifying agent as described herein, or a combination thereof.

As the aerosol generated from aerosol generating material 3, referred to herein as the first aerosol, is drawn through the tubular portion 4*a* of the mouthpiece, heat from the first aerosol may aerosolise the aerosol forming material of the second aerosol generating material, to form a second aerosol. The second aerosol may comprise a flavourant, which may be additional or complementary to the flavour of the first aerosol.

Providing a second aerosol generating material on the tubular body 4*a* can result in generation of a second aerosol which boosts or complements the flavour or visual appearance of the first aerosol.

In the present example, the article 1 has an outer circumference of about 21 mm (i.e. the article is in the demi-slim format). Preferably, the article 1 has a rod of aerosol generating material having a circumference greater than 19 mm. This has been found to provide a sufficient circumference to generate an improved and sustained aerosol over a usual aerosol generation session preferred by consumers. As the article is heated, heat transfers through the rod of aerosol generating material 3 to volatise components of the rod, and circumferences greater than 19 mm have been found to be particularly effective at producing an aerosol in this way. Since the article is to be heated to release an aerosol, improved heating efficiency can be achieved using articles having circumferences of less than about 23 mm. To achieve improved aerosol via heating, while maintaining a suitable product length, rod circumferences of greater than 19 mm and less than 23 mm are preferable. In some examples, the rod circumference can be between 20 mm and 22 mm, which has been found to provide a good balance between providing effective aerosol delivery while allowing for efficient heating.

The outer circumference of the mouthpiece 2 is substantially the same as the outer circumference of the rod of aerosol generating material 3, such that there is a smooth transition between these components. In the present example, the outer circumference of the mouthpiece 2 is about 20.8 mm.

In some examples, the tipping paper 5 comprises citrate, such as sodium citrate or potassium citrate. In such examples, the tipping paper 5 may have a citrate content of 2% by weight or less, or 1% by weight or less. Reducing the citrate content of the tipping paper 5 is thought to assist with reducing the charring effect which may occur during use.

In the present example, the tipping paper 5 extends 5 mm over the rod of aerosol generating material 3 but it can alternatively extend between 3 mm and 10 mm over the rod 3, or more preferably between 4 mm and 6 mm, to provide a secure attachment between the mouthpiece 2 and rod 3. The tipping paper 5 can have a basis weight which is higher than the basis weight of plug wraps used in the article 1, for instance a basis weight of 40 gsm to 80 gsm, more preferably between 50 gsm and 70 gsm, and in the present example 58 gsm. These ranges of basis weights have been found to result in tipping papers having acceptable tensile strength while being flexible enough to wrap around the article 1 and adhere to itself along a longitudinal lap seam on the paper. The outer circumference of the tipping paper 5, once wrapped around the mouthpiece 2, is about 21 mm.

Preferably, the length of the body of material 6 is less than about 30 mm and, preferably, less than about 25 mm or 20 mm. In the present example, the length of the body of material 6 is 20 mm.

In some embodiments, the body 6 has axial length in the range of 10 to 30 mm and, preferably, in the range of 15 to 25 mm.

In some embodiments, the body 6 has an axial length of at least 10, 12, 14, 16, 18 or 20 mm.

In some embodiments, the body 6 has an axial length of less than 36, 34, 32, 30, 28, 28, 24 or 22 mm.

In the present example, the body of material 6 is formed from filamentary tow. In the present example, the tow used in the body of material 6 has a denier per filament (d.p.f.) of 8.4 and a total denier of 21,000. Alternatively, the tow can, for instance, have a denier per filament (d.p.f.) of 9.5 and a total denier of 12,000. In the present example, the tow comprises plasticised cellulose acetate tow. The plasticiser used in the tow comprises about 7% by weight of the tow. In some embodiments, the plasticiser used in the tow comprises at least 2%, at least 3%, at least 4%, at least 5%, at least 6%, at least 7%, at least 8% or at least 9% by weight of the tow. In some embodiments, the plasticiser used in the tow comprises about 9% by weight of the tow.

In some embodiments, the plasticiser used in the tow comprises in the range of 2% to 10% by weight of the tow.

In the present example, the plasticiser is triacetin. In other examples, different materials can be used to form the body of material 6. The tow is preferably formed from cellulose acetate. The tow, whether formed from cellulose acetate or other materials, preferably has a d.p.f. of at least 5, more preferably at least 6 and still more preferably at least 7. These values of denier per filament provide a tow which has relatively coarse, thick fibres with a lower surface area which result in a lower pressure drop across the mouthpiece 2 than tows having lower d.p.f. values. Preferably, to achieve a sufficiently uniform body of material 6, the tow has a denier per filament of no more than 12 d.p.f., preferably no more than 11 d.p.f. and still more preferably no more than 10 d.p.f.

The total denier of the tow forming the body of material 6 is preferably at most 30,000, more preferably at most 28,000 and still more preferably at most 25,000. These values of total denier provide a tow which takes up a reduced proportion of the cross sectional area of the mouthpiece 2 which results in a lower pressure drop across the mouthpiece 2 than tows having higher total denier values. For appropriate firmness of the body of material 6, the tow preferably has a total denier of at least 8,000 and more preferably at least 10,000. Preferably, the denier per filament is between 5 and 12 while the total denier is between 10,000 and 25,000. More preferably, the denier per filament is between 6 and 10 while the total denier is between 11,000 and 22,000. In one embodiment, the denier per filament is about 9.5 and the total denier is about 12,000. Preferably the cross-sectional shape of the filaments of tow are 'Y' shaped, although in other embodiments other shapes such as 'X' shaped or 'O' shaped filaments can be used, with the same d.p.f. and total denier values as provided herein.

In some embodiments, the tow has a denier per filament in the range of 5 to 9.

In some embodiments, the tow has a total denier in the range of 12000 to 24000.

In some embodiments, the tow has a denier per filament of about 8.4 and a total denier of about 21,000 and, optionally, may have a 'Y' shaped cross-section. The tow may be 8.4Y21000 tow.

In some embodiments, the tow has a denier per filament of about 6 and a total denier of about 17,000 and, optionally, may have a 'Y' shaped cross-section. The tow may be 6.0Y17000HK tow.

The cross section of the filaments of tow may have an isoperimetric ratio L2/A of 25 or less, 20 or less, or 15 or less, where L is the length of the perimeter of the cross section and A is the area of the cross section. Such filaments of tow have a relatively low surface area for a given value of denier per filament, which improves delivery of aerosol to the consumer.

It is known to generate, for a given tow specification (such as 8.4Y21000), a tow capability curve which represents the pressure drop through a length of rod formed using the tow, for each of a range of tow weights. Parameters such as the rod length and circumference, wrapper thickness and tow plasticiser level are specified, and these are combined with the tow specification to generate the tow capability curve, which gives an indication of the pressure drop which would be provided by different tow weights between the minimum and maximum weights achievable using standard filter rod forming machinery. Such tow capability curves can be calculated, for instance, using software available from tow suppliers. It has been found that it is particularly advantageous to use a body of material 6 which includes filamentary tow having a weight per mm of length of the body of material 6 which is between about 10% and about 30% of the range between the minimum and maximum weights of a tow capability curve generated for the filamentary tow. This can provide an acceptable balance between providing enough tow weight to avoid shrinkage after the body 6 has been formed, providing an acceptable pressure drop, while also assisting with capsule placement within the tow, for capsules of the sizes described herein.

In some embodiments, the tow of the body of material has a weight of at least 20 mg and, preferably, at least 25 mg, 30 mg, 35 mg, 40 mg, 45 mg, 50 mg, 55 mg or 60 mg.

In some embodiments, the tow of the body of material has a weight of at most 100 mg and, preferably, at most 95 mg, 90 mg, 85 mg, 80 mg, 75 mg, 70 mg or 65 mg.

In some embodiments, the tow of the body of material has a weight in the range of 20 to 100 mg and, preferably, in the range of 30 to 90 mg, 40 to 80 mg, 50 to 70 mg or 55 to 65 mg.

In some embodiments, the tow of the body of material has a weight of about 60 mg.

In some embodiments, the axial length of the body material is about 20 mm.

In some embodiments, the average weight of the tow of the of the body of material per mm axial length of the body of material is at least 1 mg/mm and, preferably, at least 1.25 mg/mm, 1.5 mg/mm, 1.75 mg/mm, 2 mg/mm, 2.25 mg/mm, 2.5 mg/mm, 2.75 mg/mm or 3 mg/mm.

In some embodiments, the average weight of the tow of the of the body of material per mm axial length of the body of material is at most 5 mg/mm and, preferably, at most 4.75 mg/mm, 4.5 mg/mm, 4.25 mg/mm, 4 mg/mm, 3.75 mg/mm, 3.5 mg/mm or 3.25 mg/mm.

In some embodiments, the average weight of the tow of the of the body of material per mm axial length of the body of material is in the range of 1 to 5 mg/mm and, preferably, in the range of 1.5 to 4.5 mg/mm, 2 to 4 mg/mm, 2.5 to 3.5 mg/mm or 2.75 to 3.25 mg/mm.

In some embodiments, the average weight of the tow of the body of material per mm axial length of the body of material is about 3 mg/mm.

In some embodiments, the body of material comprises plasticiser.

In some embodiments, the body of material may comprise at least 3 mg of plasticiser and, preferably, at least 3.5 mg, 4 mg, 4.5 mg, 5 mg, 5.5 mg, 6 mg, 6.5 mg 7 mg, 7.5 mg, 7.6 mg or 7.7 mg of plasticiser.

In some embodiments, the body of material may comprise at most 12 mg of plasticiser and, preferably, at most 11.5 mg, 11 mg, 10.5 mg, 10 mg, 9.5 mg, 9 mg, 8.5 mg, 8 mg, 7.9 mg or 7.8 mg of plasticiser.

In some embodiments, the body of material comprises in the range of 3 to 12 mg of plasticiser and, preferably, in the range of 5 to 10 mg, 6 to 9 mg, or 7 to 8 mg of plasticiser.

In some embodiments, the body of material comprises about 7.7 mg of plasticiser.

In some embodiments, the total weight of the body of material (including the tow and plasticiser), the first and second aerosol release components, the first plug wrap that circumscribes the body of material and the adhesive that secures the first plug wrap in position, is at least 40 mg and, preferably, at least 50 mg, 60 mg, 70 mg, 80 mg, 90 mg, 100 mg, 110 mg, 115 mg or 120 mg.

In some embodiments, the total weight of the body of material (including the tow and plasticiser), the first and second aerosol release components, the first plug wrap that circumscribes the body of material and the adhesive that secures the first plug wrap in position is at most 200 mg and, preferably, at most 190 mg, 180 mg, 170 mg, 160 mg, 150 mg, 140 mg, 135 mg, 130 mg or 125 mg. In some embodiments, said total weight is in the range of 40 to 200 mg and, preferably, in the range of 60 to 180 mg, 80 to 160 mg, 100 to 140 mg, 110 to 130 mg or 115 to 125 mg. In some embodiments, said total weight is about 120 mg.

Preferably, the length of the tubular portion 4*a* is less than about 50 mm. More preferably, the length of the tubular portion 4*a* is less than about 40 mm. Still more preferably, the length of the tubular portion 4*a* is less than about 30 mm. In addition, or as an alternative, the length of the tubular portion 4*a* is preferably at least about 10 mm. Preferably, the length of the tubular portion 4*a* is at least about 15 mm. In some preferred embodiments, the length of the tubular portion 4*a* is from about 15 mm to about 25 mm, more preferably from about 18 mm to about 24 mm, even more preferably from about 20 to about 22 mm, most preferably about 21 mm. In the present example, the length of the tubular portion 4*a* is 21 mm.

Preferably, the second plug wrap 9 has a basis weight of less than 50 gsm, more preferably between about 20 gsm and 45 gsm. Preferably, the second plug wrap 9 has a thickness of between 30 μm and 60 μm, more preferably between 35 μm and 45 μm. The second plug wrap 9 is preferably a non-porous plug wrap having a permeability of less than 100 Coresta Units, for instance less than 50 Coresta Units. However, in alternative embodiments, the second plug wrap 9 can be a porous plug wrap, for instance having a permeability of greater than 200 Coresta Units.

The tubular portion 4*a* is located around and defines an air gap within the mouthpiece 2 which acts as a cooling segment. The air gap provides a chamber through which heated volatilised components generated by the aerosol generating material 3 flow. The tubular portion 4*a* is hollow to provide a chamber for aerosol accumulation yet rigid enough to withstand axial compressive forces and bending moments that might arise during manufacture and whilst the article 1 is in use. The tubular portion 4*a* provides a physical displacement between the aerosol generating material 3 and the body of material 6. The physical displacement provided by the tubular portion 4*a* will provide a thermal gradient across the length of the tubular portion 4*a*.

Preferably, the mouthpiece 2 comprises a cavity having an internal volume greater than 450 $mm^3$. Providing a cavity of at least this volume has been found to enable the formation of an improved aerosol. Such a cavity size provides sufficient space within the mouthpiece 2 to allow heated volatilised components to cool, therefore allowing the exposure of the aerosol generating material 3 to higher temperatures than would otherwise be possible, since they may result in an aerosol which is too warm. In the present example, the cavity is formed by the tubular portion 4*a*, but in alternative arrangements it could be formed within a different part of the mouthpiece 2. More preferably, the mouthpiece 2 comprises a cavity, for instance formed within the tubular portion 4*a*, having an internal volume greater than 500 $mm^3$, and still more preferably greater than 550 $mm^3$, allowing further improvement of the aerosol. In some examples, the internal cavity comprises a volume of between about 550 $mm^3$ and about 750 $mm^3$, for instance about 600 $mm^3$ or 700 $mm^3$.

The tubular portion 4*a* can be configured to provide a temperature differential of at least 40 degrees Celsius between a heated volatilised component entering a first, upstream end of the tubular portion 4*a* and a heated volatilised component exiting a second, downstream end of the tubular portion 4*a*. The tubular portion 4*a* is preferably configured to provide a temperature differential of at least 60 degrees Celsius, preferably at least 80 degrees Celsius and more preferably at least 100 degrees Celsius between a heated volatilised component entering a first, upstream end of the tubular portion 4*a* and a heated volatilised component exiting a second, downstream end of the tubular portion 4*a*. This temperature differential across the length of the tubular portion 4*a* protects the temperature sensitive body of material 6 from the high temperatures of the aerosol generating material 3 when it is heated.

In alternative articles, the tubular portion 4*a* can be replaced with an alternative cooling element, for instance an element formed from a body of material which allows aerosol to pass through it longitudinally, and which also performs the function of cooling the aerosol.

The mouthpiece 2 of the article 1 comprises an upstream end 3*a* adjacent to the aerosol generating substrate 3 and a downstream end 2*b* distal from the aerosol generating substrate 3.

In the present example, the aerosol generating material 3 is wrapped in a wrapper 10. The wrapper 10 can, for instance, be a paper or paper-backed foil wrapper. In the present example, the wrapper 10 is substantially impermeable to air. In alternative embodiments, the wrapper 10 preferably has a permeability of less than 100 Coresta Units, more preferably less than 60 Coresta Units. It has been found that low permeability wrappers, for instance having a permeability of less than 100 Coresta Units, more preferably less than 60 Coresta Units, results in an improvement in the aerosol formation in the aerosol generating material 3. Without wishing to be bound by theory, it is hypothesised that this is due to reduced loss of aerosol compounds through the wrapper 10. The permeability of the wrapper 10 can be measured in accordance with ISO 2965:2009 concerning the determination of air permeability for materials used as cigarette papers, filter plug wrap and filter joining paper.

In the present embodiment, the wrapper 10 comprises aluminium foil. Aluminium foil has been found to be particularly effective at enhancing the formation of aerosol within the aerosol generating material 3. In the present example, the aluminium foil has a metal layer having a thickness of about 6 μm. In the present example, the aluminium foil has a paper backing. However, in alternative arrangements, the aluminium foil can be other thicknesses, for instance between 4 μm and 16 μm in thickness. The aluminium foil also need not have a paper backing, but could have a backing formed from other materials, for instance to help provide an appropriate tensile strength to the foil, or it could have no backing material. Metallic layers or foils other than aluminium can also be used. The total thickness of the wrapper is preferably between 20 μm and 60 μm, more preferably between 30 μm and 50 μm, which can provide a wrapper having appropriate structural integrity and heat transfer characteristics. The tensile force which can be applied to the wrapper before it breaks can be greater than 3,000 grams force, for instance between 3,000 and 10,000 grams force or between 3,000 and 4,500 grams force.

In some examples, the wrapper 10 surrounding the aerosol generating material 3 has a high level of permeability, for example greater than about 1000 Coresta Units, or greater than about 1500 Coresta Units, or greater than about 2000 Coresta Units. The permeability of the wrapper 10 can be measured in accordance with ISO 2965:2009 concerning the determination of air permeability for materials used as cigarette papers, filter plug wrap and filter joining paper.

The wrapper 10 may be formed from a material with a high inherent level of permeability, an inherently porous material, or may be formed from a material with any level of inherent permeability where the final level of permeability is achieved by providing the wrapper 10 with a permeable zone or area. Providing a permeable wrapper 10 provides a route for air to enter the article. The wrapper 10 can be provided with a permeability such that the amount of air entering through the rod of aerosol generating material is relatively more than the amount of air entering the article through the ventilation holes 12 in the mouthpiece. An article having this arrangement may produce a more flavoursome aerosol which may be more satisfactory to the user.

In the present example, the aerosol-former material added to the aerosol generating substrate 3 comprises 14% by weight of the aerosol generating substrate 3. Preferably, the aerosol-former material comprises at least 5% by weight of the aerosol generating substrate, more preferably at least 10%. Preferably, the aerosol-former material comprises less than 25% by weight of the aerosol generating substrate, more preferably less than 20%, for instance between 10% and 20%, between 12% and 18% or between 13% and 16%.

Preferably the aerosol generating material 3 is provided as a cylindrical rod of aerosol generating material. Irrespective of the form of the aerosol generating material, it preferably has a length of about 10 mm to 100 mm. In some embodiments, the length of the aerosol generating material is preferably in the range about 25 mm to 50 mm, more preferably in the range about 30 mm to 45 mm, and still more preferably about 30 mm to 40 mm.

In some examples, the article 1 may be configured such that there is a separation (i.e. a minimum distance) between a heater of the non-combustible aerosol provision device 100 and the tubular body 4*a*. This prevents heat from the heater from damaging the material forming the tubular body 4*a*.

The minimum distance between a heater of the non-combustible aerosol provision device 100 and the tubular body 4*a* may be 3 mm or greater. In some examples, minimum distance between the heater of the non-combustible aerosol provision device 100 and the tubular body 4*a* may be in the range 3 mm to 10 mm, for example 3 mm, 4 mm, 5 mm, 6 mm, 7 mm, 8 mm, 9 mm or 10 mm.

The separation between the heater of the non-combustible aerosol provision device 100 and the tubular body 4*a* may be achieved by, for example, adjusting the length of the rod of aerosol generating material 3.

The volume of aerosol generating material 3 provided can vary from about 200 $mm^3$ to about 4300 $mm^3$, preferably from about 500 $mm^3$ to 1500 $mm^3$, more preferably from about 1000 $mm^3$ to about 1300 $mm^3$. The provision of these volumes of aerosol generating material, for instance from about 1000 $mm^3$ to about 1300 $mm^3$, has been advantageously shown to achieve a superior aerosol, having a greater visibility and sensory performance compared to that achieved with volumes selected from the lower end of the range.

The mass of aerosol generating material 3 provided can be greater than 200 mg, for instance from about 200 mg to 400 mg, preferably from about 230 mg to 360 mg, more preferably from about 250 mg to 360 mg. It has been advantageously found that providing a higher mass of aerosol generating material results in improved sensory performance compared to aerosol generated from a lower mass of tobacco material.

Preferably the aerosol generating material or substrate is formed from tobacco material as described herein, which includes a tobacco component.

In the tobacco material described herein, the tobacco component preferably contains paper reconstituted tobacco. The tobacco component may also contain leaf tobacco, extruded tobacco, and/or bandcast tobacco.

The aerosol generating material 3 can comprise reconstituted tobacco material having a density of less than about 700 milligrams per cubic centimetre (mg/cc). Such tobacco material has been found to be particularly effective at providing an aerosol generating material which can be heated quickly to release an aerosol, as compared to denser materials. For instance, the inventors tested the properties of various aerosol generating materials, such as bandcast reconstituted tobacco material and paper reconstituted tobacco material, when heated. It was found that, for each given aerosol generating material, there is a particular zero heat flow temperature below which net heat flow is endothermic, in other words more heat enters the material than leaves the material, and above which net heat flow is exothermic, in other words more heat leaves the material than enters the material, while heat is applied to the material. Materials having a density less than 700 mg/cc had a lower zero heat flow temperature. Since a significant portion of the heat flow out of the material is via the formation of aerosol, having a lower zero heat flow temperature has a beneficial effect on the time it takes to first release aerosol from the aerosol generating material. For instance, aerosol generating materials having a density of less than 700 mg/cc were found to have a zero heat flow temperature of less than 164° C., as compared to materials with a density over 700 mg/cc, which had zero heat flow temperatures greater than 164° C.

The density of the aerosol generating material also has an impact on the speed at which heat conducts through the material, with lower densities, for instance those below 700 mg/cc, conducting heat more slowly through the material, and therefore enabling a more sustained release of aerosol.

Preferably, the aerosol generating material 3 comprises reconstituted tobacco material having a density of less than about 700 mg/cc, for instance paper reconstituted tobacco material. More preferably, the aerosol generating material 3 comprises reconstituted tobacco material having a density of less than about 600 mg/cc. Alternatively or in addition, the aerosol generating material 3 preferably comprises reconstituted tobacco material having a density of at least 350 mg/cc, which is considered to allow for a sufficient amount of heat conduction through the material.

The tobacco material may be provided in the form of cut rag tobacco. The cut rag tobacco can have a cut width of at least 15 cuts per inch (about 5.9 cuts per cm, equivalent to a cut width of about 1.7 mm). Preferably, the cut rag tobacco has a cut width of at least 18 cuts per inch (about 7.1 cuts per cm, equivalent to a cut width of about 1.4 mm), more preferably at least 20 cuts per inch (about 7.9 cuts per cm, equivalent to a cut width of about 1.27 mm). In one example, the cut rag tobacco has a cut width of 22 cuts per inch (about 8.7 cuts per cm, equivalent to a cut width of about 1.15 mm). Preferably, the cut rag tobacco has a cut width at or below 40 cuts per inch (about 15.7 cuts per cm, equivalent to a cut width of about 0.64 mm). Cut widths between 0.5 mm and 2.0 mm, for instance between 0.6 mm and 1.5 mm, or between 0.6 mm and 1.7 mm have been found to result in tobacco material which is preferably in terms of surface area to volume ratio, particularly when heated, and the overall density and pressure drop of the substrate 3. The cut rag tobacco can be formed from a mixture of forms of tobacco material, for instance a mixture of one or more of paper reconstituted tobacco, leaf tobacco, extruded tobacco and bandcast tobacco. Preferably the tobacco material comprises paper reconstituted tobacco or a mixture of paper reconstituted tobacco and leaf tobacco.

In the tobacco material described herein, the tobacco material may contain a filler component. The filler component is generally a non-tobacco component, that is, a component that does not include ingredients originating from tobacco. The filler component may be a non-tobacco fibre such as wood fibre or pulp or wheat fibre. The filler component may also be an inorganic material such as chalk, perlite, vermiculite, diatomaceous earth, colloidal silica, magnesium oxide, magnesium sulphate, magnesium carbonate. The filler component may also be a non-tobacco cast material or a non-tobacco extruded material. The filler component may be present in an amount of 0 to 20% by weight of the tobacco material, or in an amount of from 1 to 10% by weight of the composition. In some embodiments, the filler component is absent.

In the tobacco material described herein, the tobacco material contains an aerosol-former material. In this context, an "aerosol-former material" is an agent that promotes the generation of an aerosol. An aerosol-former material may promote the generation of an aerosol by promoting an initial vaporisation and/or the condensation of a gas to an inhalable solid and/or liquid aerosol. In some embodiments, an aerosol-former material may improve the delivery of flavour from the aerosol generating material. In general, any suitable aerosol-former material or agents may be included in the aerosol generating material of the invention, including those described herein. Other suitable aerosol-former materials include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate. In some embodiments, the aerosol-former material may be glycerol, propylene glycol, or a mixture of glycerol and propylene glycol. Glycerol may be present in an amount of from 10 to 20% by weight of the tobacco material, for example 13 to 16% by weight of the composition, or about 14% or 15% by weight of the composition. Propylene glycol, if present, may be present in an amount of from 0.1 to 0.3% by weight of the composition.

The aerosol-former material may be included in any component, for example any tobacco component, of the tobacco material, and/or in the filler component, if present. Alternatively or additionally the aerosol-former material may be added to the tobacco material separately. In either case, the total amount of the aerosol-former material in the tobacco material can be as defined herein.

The tobacco material can contain between 10% and 90% by weight tobacco leaf, wherein the aerosol-former material is provided in an amount of up to about 10% by weight of the leaf tobacco. To achieve an overall level of aerosol-former material between 10% and 20% by weight of the tobacco material, it has been advantageously found that this can be added in higher weight percentages to the another component of the tobacco material, such as reconstituted tobacco material.

The tobacco material described herein contains nicotine. The nicotine content is from 0.5 to 1.75% by weight of the tobacco material, and maybe, for example, from 0.8 to 1.5% by weight of the tobacco material. Additionally or alternatively, the tobacco material contains between 10% and 90% by weight tobacco leaf having a nicotine content of greater than 1.5% by weight of the tobacco leaf. It has been advantageously found that using a tobacco leaf with nicotine content higher than 1.5% in combination with a lower nicotine base material, such as paper reconstituted tobacco, provides a tobacco material with an appropriate nicotine level but better sensory performance than the use of paper reconstituted tobacco alone. The tobacco leaf, for instance cut rag tobacco, can, for instance, have a nicotine content of between 1.5% and 5% by weight of the tobacco leaf.

The tobacco material described herein can contain an aerosol modifying agent, such as any of the flavours described herein. In one embodiment, the tobacco material contains menthol, forming a mentholated article. The tobacco material can comprise from 3 mg to 20 mg of menthol, preferably between 5 mg and 18 mg and more preferably between 8 mg and 16 mg of menthol. In the present example, the tobacco material comprises 16 mg of menthol. The tobacco material can contain between 2% and 8% by weight of menthol, preferably between 3% and 7% by weight of menthol and more preferably between 4% and 5.5% by weight of menthol. In one embodiment, the tobacco material includes 4.7% by weight of menthol. Such high levels of menthol loading can be achieved using a high percentage of reconstituted tobacco material, for instance greater than 50% of the tobacco material by weight. Alternatively or additionally, the use of a high volume of aerosol generating material, for instance tobacco material, can increase the level of menthol loading that can be achieved, for instance where greater than about 500 $mm^3$ or suitably more than about 1000 $mm^3$ of aerosol generating material, such as tobacco material, are used.

In the compositions described herein, where amounts are given in % by weight, for the avoidance of doubt this refers to a dry weight basis, unless specifically indicated to the contrary. Thus, any water that may be present in the tobacco material, or in any component thereof, is entirely disregarded for the purposes of the determination of the weight %. The water content of the tobacco material described herein may vary and may be, for example, from 5 to 15% by weight. The water content of the tobacco material described herein may vary according to, for example, the temperature, pressure and humidity conditions at which the compositions are maintained. The water content can be determined by Karl-Fisher analysis, as known to those skilled in the art. On the other hand, for the avoidance of doubt, even when the aerosol-former material is a component that is in liquid phase, such as glycerol or propylene glycol, any component other than water is included in the weight of the tobacco material. However, when the aerosol-former material is provided in the tobacco component of the tobacco material, or in the filler component (if present) of the tobacco material, instead of or in addition to being added separately to the tobacco material, the aerosol-former material is not included in the weight of the tobacco component or filler component, but is included in the weight of the "aerosol-former material" in the weight % as defined herein. All other ingredients present in the tobacco component are included in the weight of the tobacco component, even if of non-tobacco origin (for example non-tobacco fibres in the case of paper reconstituted tobacco).

In an embodiment, the tobacco material comprises the tobacco component as defined herein and the aerosol-former material as defined herein. In an embodiment, the tobacco material consists essentially of the tobacco component as defined herein and the aerosol-former material as defined herein. In an embodiment, the tobacco material consists of the tobacco component as defined herein and the aerosol-former material as defined herein.

Paper reconstituted tobacco is present in the tobacco component of the tobacco material described herein in an amount of from 10% to 100% by weight of the tobacco component. In embodiments, the paper reconstituted tobacco is present in an amount of from 10% to 80% by weight, or 20% to 70% by weight, of the tobacco component. In a further embodiment, the tobacco component consists essentially of, or consists of, paper reconstituted tobacco. In preferred embodiments, leaf tobacco is present in the tobacco component of the tobacco material in an amount of from at least 10% by weight of the tobacco component. For instance, leaf tobacco can be present in an amount of at least 10% by weight of the tobacco component, while the remainder of the tobacco component comprises paper reconstituted tobacco, bandcast reconstituted tobacco, or a combination of bandcast reconstituted tobacco and another form of tobacco such as tobacco granules.

Paper reconstituted tobacco refers to tobacco material formed by a process in which tobacco feedstock is extracted with a solvent to afford an extract of solubles and a residue comprising fibrous material, and then the extract (usually after concentration, and optionally after further processing) is recombined with fibrous material from the residue (usually after refining of the fibrous material, and optionally with the addition of a portion of non-tobacco fibres) by deposition of the extract onto the fibrous material. The process of recombination resembles the process for making paper.

The paper reconstituted tobacco may be any type of paper reconstituted tobacco that is known in the art. In a particular embodiment, the paper reconstituted tobacco is made from a feedstock comprising one or more of tobacco strips, tobacco stems, and whole leaf tobacco. In a further embodiment, the paper reconstituted tobacco is made from a feedstock consisting of tobacco strips and/or whole leaf tobacco, and tobacco stems.

However, in other embodiments, scraps, fines and winnowings can alternatively or additionally be employed in the feedstock.

The paper reconstituted tobacco for use in the tobacco material described herein may be prepared by methods which are known to those skilled in the art for preparing paper reconstituted tobacco.

In some embodiments, it can be particularly advantageous to use a hollow tubular element 8 having a length of greater than about 10 mm, for instance between about 10 mm and about 30 mm or between about 12 mm and about 25 mm. It has been found that a consumer's lips are likely to extend in some cases to about 12 mm from the mouth end of the article 1 when drawing aerosol through the article 1, and therefore a hollow tubular element 8 having a length of at least 10 mm or at least 12 mm means that most of the consumer's lips surround this element 8.

An aerosol modifying agent is provided within the body of material 6, in the present example in the form of a capsule 11, and the first plug wrap 7 surrounds the body of material 6.

The aerosol modifying component comprises first and second capsules 11A, 11B. In the present embodiment, the aerosol modifying component comprises the mouthpiece 2 and thus the mouthpiece 2 comprises the first and second capsules 11A, 11B. In alternative embodiments, the first and second capsules 11A, 11B are provided in an aerosol modifying component that is upstream of the mouthpiece 2.

The first and second capsules 11A, 11B are provided in the body of material 6. The first plug wrap 7 surrounds the body of material 6. In the present embodiment, the first plug wrap 7 is an oil-resistant first plug wrap 7.

In some embodiments, the first plug wrap 7 has a basis weight greater than 27 gsm and preferably, greater than 30, 35, 40, 45 or 50 gsm. In one such embodiment, the basis weight of the first plug wrap 7 is about 50 gsm. The first plug wrap 7 may be coated.

Each capsule 11A, 11B can comprise a breakable capsule, for instance a capsule which has a solid, frangible shell surrounding a liquid payload. The first and second capsules 11A, 11B are entirely embedded within the body of material 6. In other words, each capsule 11A, 11B is completely surrounded by the material forming the body 6. In other examples, at least three capsules may be disposed within the body of material 6, for instance three or four breakable capsules. The length of the body of material 6 can be increased to accommodate the number of capsules required.

The first and second capsules 11A, 11B may be the same as each other, or may differ from one another in terms of size and/or capsule payload. In other examples, multiple bodies of material 6 may be provided, with each body containing one or more capsules. That is, the aerosol modifying component may comprise two or more bodies each containing one or more capsules.

The first and second capsules 11A, 11B each has a core-shell structure. In other words, each capsule 11A, 11B comprises a shell encapsulating a liquid agent, for instance a flavourant or other agent, which can be any one of the flavourants or aerosol modifying agents described herein. The shell of the capsule can be ruptured by a user to release the flavourant or other agent into the body of material 6. The first plug wrap 7 can comprise a barrier coating to make the material of the plug wrap substantially impermeable to the liquid payload of the capsule 11. Alternatively or in addition, the second plug wrap 9 and/or tipping paper 5 can comprise a barrier coating to make the material of that plug wrap and/or tipping paper substantially impermeable to the liquid payload of the capsule 11.

In some embodiments, the first plug wrap 7 has a basis weight of less than 50 gsm, more preferably between about 20 gsm and 40 gsm. Preferably, the first plug wrap 7 has a thickness of between 30 μm and 60 μm, more preferably between 35 μm and 45 μm. Preferably, the first plug wrap 7 is a non-porous plug wrap, for instance having a permeability of less than 100 Coresta units, for instance less than 50 Coresta units. However, in other embodiments, the first plug wrap 7 can be a porous plug wrap, for instance having a permeability of greater than 200 Coresta Units.

In the present example, each capsule 11A, 11B is spherical and has a diameter of about 3 mm. In other examples, other shapes and sizes of capsule can be used. The total weight of each capsule 11A, 11B may be in the range about 5 mg to about 50 mg and, preferably, in the range of about 10 to 30 mg. In the present example, each capsule 11A, 11B has a weight of about 14 mg.

Figure 2:
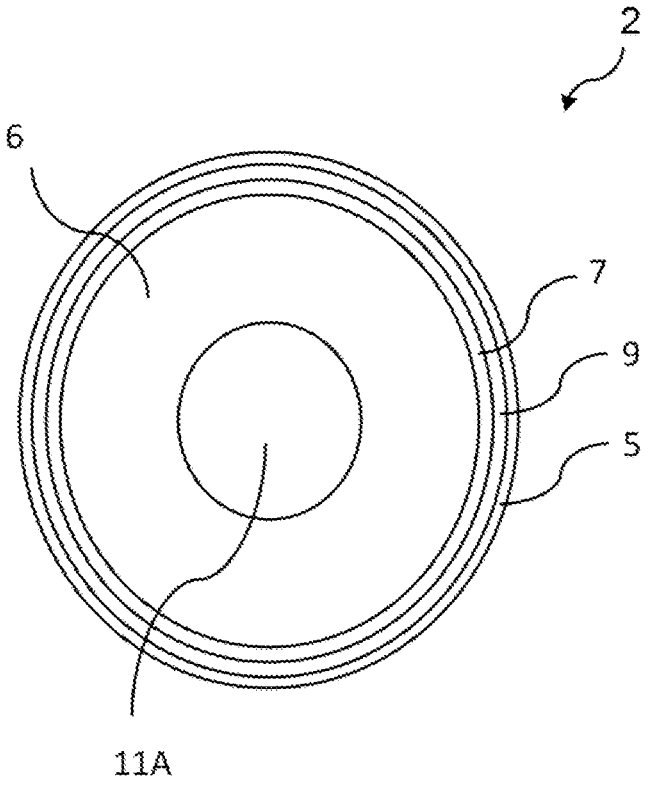
FIG. 2 is a cross sectional view of the capsule-containing mouthpiece shown in FIG. 1.

A cross section of the mouthpiece 2' is shown in FIG. 2, this being taken through line A-A' of FIG. 1. FIG. 2 shows the first capsule 11A, the body of material 6, the first and second plug wraps 7, 9 and the tipping paper 5. In the present example, the first capsule 11A is centred on the longitudinal axis (not shown) of the mouthpiece 2'. In the present example, the second capsules 11B is also centred on the longitudinal axis of the mouthpiece 2. The first and second plug wraps 7, 9 and tipping 5 are arranged concentrically around the body of material 6.

The breakable first and second capsules 11A, 11B each has a core-shell structure. That is, the encapsulating material or barrier material creates a shell around a core that comprises the aerosol modifying agent. The shell structure hinders migration of the aerosol modifying agent during storage of the article 1 but allows controlled release of the aerosol modifying agent, also referred to as an aerosol modifier, during use.

In some cases, the barrier material (also referred to herein as the encapsulating material) is frangible. Each capsule 11A, 11B is crushed or otherwise fractured or broken by the user to release the encapsulated aerosol modifier. Typically, one of the capsules 11A, 11B is broken immediately prior to heating being initiated but the user can select when to release the aerosol modifier of said capsule 11A, 11B. The user can then choose to break the other one of the first and second capsules 11A, 11B at a later time, for example, after heating being initiated. The user may choose to break said other one of the first and second capsules 11A, 11B once some of the aerosol has been released from the aerosol generating material, such that the remaining aerosol generating material is modified by the aerosol modifying agent of said other one of the first and second capsules 11A, 11B. Alternatively, the user may choose to break both of the capsules 11A, 11B simultaneously.

The term "breakable capsule" refers to a capsule, wherein the shell can be broken by means of a pressure to release the core; more specifically the shell can be ruptured under the pressure imposed by the user's fingers when the user wants to release the core of the capsule.

In some cases, the barrier material is heat resistant. That is to say, in some cases, the barrier will not rupture, melt or otherwise fail at the temperature reached at the capsule site during operation of the aerosol provision device. Illustratively, a capsule located in a mouthpiece may be exposed to temperatures in the range of 30° C. to 100° C. for example, and the barrier material may continue to retain the liquid core up to at least about 50° C. to 120° C.

In other cases, each capsule 11A, 11B releases the core composition on heating, for example by melting of the barrier material or by capsule swelling leading to rupture of the barrier material.

The total weight of each capsule 11A, 11B may be in the range of about 1 mg to about 100 mg, suitably about 5 mg to about 60 mg, about 8 mg to about 50 mg, about 10 mg to about 20 mg, or about 12 mg to about 18 mg.

The total weight of the core formulation may be in the range of about 2 mg to about 90 mg, suitably about 3 mg to about 70 mg, about 5 mg to about 25 mg, about 8 mg to about 20 mg, or about 10 mg to about 15 mg.

In some embodiments, each capsule 11A, 11B comprises a core as described above, and a shell. The capsules 11A, 11B may each present a crush strength from about 4.5 N to about 40 N, more preferably from about 5 N to about 30 N or to about 28 N (for instance about 9.8 N to about 24.5 N). The capsule burst strength of each capsule 11A, 11B can be measured when said capsule 11A, 11B is removed from the body of material 6 and using a force gauge to measure the force at which the capsule 11A, 11B bursts when pressed between two flat metal plates. A suitable measurement device is the Sauter FK 50 force gauge with a flat headed attachment, which can be used to crush the capsule against a flat, hard surface having a surface similar to the attachment.

The capsules 11A, 11B may be substantially spherical and have a diameter of at least about 0.4 mm, 0.6 mm, 0.8 mm, 1.0 mm, 2.0 mm, 2.5 mm, 2.8 mm or 3.0 mm. The diameter of the capsules 11A, 11B may be less than about 10.0 mm, 8.0 mm, 7.0 mm, 6.0 mm, 5.5 mm, 5.0 mm, 4.5 mm, 4.0 mm, 3.5 mm or 3.2 mm. Illustratively, the capsule 11A, 11B diameter may be in the range of about 0.4 mm to about 10.0 mm, about 0.8 mm to about 6.0 mm, about 2.5 mm to about 5.5 mm or about 2.8 mm to about 3.2 mm. In some cases, each capsule 11A, 11B may have a diameter of about 3.0 mm. These sizes are particularly suitable for incorporation of the capsules 11A, 11B into an article as described herein.

The cross-sectional area of each capsule 11A, 11B at its largest cross sectional area is in some embodiments less than 28% of the cross sectional area of the portion of the mouthpiece 2' in which the capsule 11A, 11B is provided, more preferably less than 27% and still more preferably less than 25%. For instance, for a spherical capsule 11A, 11B having a diameter of 3.0 mm, the largest cross sectional area of the capsule is 7.07 $mm^2$. For the mouthpiece 2' having a circumference of 21 mm as described herein, the body of material 6 has an outer circumference of 20.8 mm, and the radius of this component will be 3.31 mm, corresponding to a cross sectional area of 34.43 $mm^2$. The capsule cross sectional area is, in this example, 20.5% of the cross-sectional area of the mouthpiece 2'. As another example, if a capsule 11A, 11B had a diameter of 3.2 mm, its largest cross sectional area would be 8.04 $mm^2$. In this case, the cross sectional area of the capsule 11A, 11B would be 23.4% of the cross sectional area of the body of material 6. A capsule 11A, 11B with a largest cross sectional area less than 28% of the cross sectional area of the portion of the mouthpiece 2 in which the capsule 11A, 11A is provided has the advantage that the pressure drop across the mouthpiece 2 is reduced as compared to capsules 11A, 11B with larger cross sectional areas and adequate space remains around the capsule 11A, 11B for aerosol to pass without the body of material 6 removing significant amounts of the aerosol mass as it passes through the mouthpiece 2. In some embodiments, the first and second capsules 11A, 11B are the same size. In other embodiments, the first and second capsules 11A, 11B are different sizes.

Preferably the pressure drop or difference (also referred to a resistance to draw) across the article, measured as the open pressure drop (i.e. with the ventilation openings open), reduces by less than 10 $mmH_2O$ when one of the first and second capsule 11A, 11B is broken. More preferably, the open pressure drop reduces by less than 8 $mmH_2O$ and more preferably less than 6 $mmH_2O$ or less than 5 $mmH_2O$. These values are measured as the average achieved by at least 80 articles made to the same design. Such small changes in pressure drop mean that other aspects of the product design, such as setting the correct ventilation level for a given product pressure drop, can be achieved irrespective of whether or not the consumer chooses to break one of the first and second capsules 11A, 11B.

Preferably the pressure drop or difference (also referred to a resistance to draw) across the article, measured as the open pressure drop (i.e. with the ventilation openings open), reduces by less than 20 $mmH_2O$ when both of the first and second capsules 11A, 11B are broken. More preferably, the open pressure drop reduces by less than 16 $mmH_2O$ and more preferably by less than 12 $mmH_2O$ or less than 10 $mmH_2O$. These values are measured as the average achieved by at least 80 articles made to the same design. Such small changes in pressure drop mean that other aspects of the product design, such as setting the correct ventilation level for a given product pressure drop, can be achieved irrespective of whether or not the consumer chooses to break both of the capsules 11A, 11B.

The pressure drop or difference (also referred to a resistance to draw) across the mouthpiece, for instance the part of the article 1 downstream of the aerosol generating material 3, is preferably less than about 50 $mmH_2O$ and preferably less than about 40 $mmH_2O$ when the first and second capsules 11A, 11B are both unbroken. Such pressure drops have been found to allow sufficient aerosol, including desirable compounds such as flavour compounds, to pass through the mouthpiece 2 to the consumer.

In some embodiments, the pressure drop across the mouthpiece 2 when the first and second capsules 11A, 11B are unbroken is at most 65 $mmH_2O$ and, preferably, is at most 60, 55, 50, 45 or 40 $mmH_2O$. In some embodiments, the pressure drop across the mouthpiece 2 when the first and second capsules 11A, 11B are unbroken is at least 15 $mmH_2O$ and, preferably, is at least 20, 25, 30, or 35 $mmH_2O$. These values of pressure drop enable the mouthpiece 2 to slow down the aerosol as it passes through the mouthpiece 2 such that the temperature of the aerosol has time to reduce before reaching the downstream end 2*b* of the mouthpiece 2.

In some embodiments, the pressure drop across the mouthpiece 2 when the first and second capsules 11A, 11B are unbroken is in the range of 15 to 65 $mmH_2O$ and, preferably, 20 to 55 $mmH_2O$ and, preferably, is in the range of 25 to 50 $mH_2O$ and, preferably, in the range of 30 to 45 $mmH_2O$ and, preferably, in the range of 35 to 40 $mmH_2O$.

In some embodiments, the pressure drop across the mouthpiece 2 when the first and second capsules 11A, 11B are unbroken is about 38.5 $mmH_2O$ In some embodiments, the body of material 6 with the capsules 11A, 11B therein has a hardness in the range of about 75% to 90% and, preferably, in the range of about 80% to 85%, or, 81% to 83%. In some embodiments, the body of materials 6 with the capsules 11A, 11B therein has a hardness of about 82%. This refers to the hardness of the body of material 6 with the capsules 11A, 11B therein prior to the body of material 6 being incorporated into the article 1.

In some embodiments, the hardness of the mouthpiece 2 at the body of material 6 once the body of material 6 has been incorporated into the article 1 and attached to the remainder of the article 1 by the tipping paper 5, is in the range of about 78% to 93% and, preferably, in the range of about 83% to 88%, or, 84% to 87%.

The hardness of the body 6 may be measured according to the following protocol. Where the hardness of a section is referred to herein, the hardness is that as determined by the following measurement process. Any suitable device may be used for performing the measurement, such as the Borgwaldt Hardness Tester H10.

Hardness is defined as the ratio between the height h0 of a body and the height h1 of the body under a defined load, stated as a percentage of h0. Hardness may be expressed as:

$$\text{Hardness}=(h1/h0)\times 100$$

For an individual body, or a body contained in a multi-section rod, the hardness measurement is performed at the longitudinal centre point of the body.

A load bar is used to apply the defined load to the body. The length of the load bar should be significantly higher than that of the specimen to be measured. Prior to the hardness measurement, the body to be measured is conditioned according to ISO 3402 for a minimum of 48 hours, and is maintained in environmental conditions according to ISO 3402 during the measurement.

To perform the hardness measurement, a body is placed into the Hardness Tester H10, a pre-load of 2 g is applied to the body, and after 1 s the initial height h0 of the body under the 2 g pre-load is recorded. The pre-load is then removed and a load bar bearing a load of 150 g is lowered onto the sample at a rate of 0.6 mm/s, after 5 s the height h1 of the body under the 150 g load is measured.

The hardness of the body 6 is determined as the average hardness of at least 20 bodies 6 measured according to this protocol.

The first capsule 11A is located in a first portion P1 of the aerosol modifying component and the second capsule 11B is located in a second portion P2 of the aerosol modifying component. That is, in the present embodiment the first capsule 11A is located in a first portion P1 of the mouthpiece 2 and the second capsule 11B is located in a second portion P2 of the mouthpiece 2.

In some embodiments, when the aerosol generating material 3 is heated to provide an aerosol, for instance within a non-combustible aerosol provision device as described herein, the first portion P1 of the mouthpiece 2 in which the first capsule 11A is located reaches a temperature of between 58 and 70 degrees Centigrade during use of the system to generate an aerosol. As a result of this temperature, the first capsule 11A contents are warmed sufficiently to promote volatisation of the contents of the first capsule 11A, for instance a first aerosol modifying agent, into the aerosol formed by the system as the aerosol passes through the mouthpiece 2. Warming the content of the first capsule 11A can take place, for instance, before the first capsule 11A has been broken, such that when the first capsule 11A is broken, its contents are more readily released into the aerosol passing through the mouthpiece 2. Alternatively, the content of the first capsule 11A can be warmed to this temperature after the first capsule 11A has been broken, again resulting in the increased release of the content into the aerosol. Advantageously, mouthpiece temperatures in the range of 58 to 70 degrees Centigrade have been found to be high enough that the first capsule 11A content can be more readily released, but low enough that the outer surface of the portion of the mouthpiece 2 in which the first capsule 11A is located does not reach an uncomfortable temperature for the consumer to touch in order to burst the first capsule 11A by squeezing on the mouthpiece 2.

A maximum temperature in the range of 58° C. to 70° C., preferably in the range of 59° C. to 65° C. and more preferably in the range of 60° C. to 65° C. has been found to be particularly advantageous in relation to helping to volatise the contents of the first capsule 11A while maintaining a suitable outer surface temperature of the mouthpiece 2.

A maximum temperature in the range of 58° C. to 70° C., preferably in the range of 59° C. to 65° C. and more preferably in the range of 60° C. to 65° C. has been found to be particularly advantageous in relation to helping to volatise the contents of the second capsule 11B while maintaining a suitable outer surface temperature of the mouthpiece 2.

In some embodiments, the maximum temperature of the first capsule 11A is in the range of 62° C. to 70° C. and/or the maximum temperature of the second capsule 11B is in the range of 58° C. to 66° C. Preferably, the maximum temperature of the first capsule 11A is in the range of 65° C. to 68° C. and/or the maximum temperature of the second capsules 11B is in the range of 60° C. to 63° C.

The first capsule 11A is breakable by external force applied to the mouthpiece 2, for instance by a consumer using their fingers or other mechanism to squeeze the mouthpiece 2. As described above, the first portion P1 of the mouthpiece 2 in which the first capsule 11A is located is arranged to reach a temperature of greater than 58° C. during use of the aerosol provision system to generate an aerosol. Preferably, the burst strength of the first capsule 11A when located within the mouthpiece 2 and prior to heating of the aerosol generating material 3 is between 1500 and 4000 grams force. Preferably, the burst strength of the first capsule 11A when located within the mouthpiece 2 and within 30 seconds of use of the aerosol provision system to generate an aerosol is between 1000 and 4000 grams force. Accordingly, despite being subjected to a temperature above 58° C., for instance between 58° C. to 70° C., the first capsule 11A is able to maintain a burst strength within a range which has been found to enable the capsule 11 to be readily crushable by a consumer, while providing the consumer with sufficient tactile feedback that the first capsule 11AA has been broken. Maintaining such a burst strength is achieved by selecting an appropriate gelling agent for the first capsule 11A, as described herein, such as a polysaccharide including, for instance, gum Arabic, gellan gum, acacia gum, xanthan gums or carrageenans, alone or in combination with gelatine. In addition, a suitable wall thickness for the capsule shell should be selected.

Suitably, the burst strength of the first capsule 11A when located within the mouthpiece 2 and prior to heating of the aerosol generating material is between 2000 and 3500 grams force, or between 2500 and 3500 grams force. Suitably, the burst strength of the first capsule 11A when located within the mouthpiece 2 and within 30 s of use of the system to generate an aerosol is between 1500 and 4000 grams force, or between 1750 and 3000 grams force. In one example, the average burst strength of the first capsule 11A when located within the mouthpiece 2 and prior to heating of the aerosol generating material is about 3175 grams force and the average burst strength of the first capsule 11A when located within the mouthpiece and within 30 s of use of the system to generate an aerosol is about 2345 grams force.

When the aerosol generating material 3 is heated to provide an aerosol, for instance within a non-combustible aerosol provision device as described herein, the second portion P2 of the mouthpiece 2 in which the second capsule 11B is located reaches a temperature of at least 4 degrees Celsius lower than the temperature at the first portion P1 of the mouthpiece 2 during use of the system to generate an aerosol. In the present example, the temperature is at least 5 degrees lower. That is, if the first portion P1 is heated to a temperature between 58 and 70 degrees Celsius during use of the system to generate an aerosol then the second portion P2 is heated to a temperature at least 5 degrees Celsius lower. For instance, if the first portion P1 of the mouthpiece 2 is heated to a temperature of 70 degrees Celsius during use of the system to generate an aerosol then the second portion P2 is heated to a temperature of 65 degrees Celsius or lower. As another example, if the first portion P1 of the mouthpiece 2 is heated to a temperature of 58 degrees Celsius during use of the system to generate an aerosol then the second portion P2 is heated to a temperature of 53 degrees Celsius or lower.

In some preferred embodiment, the temperature of the second portion P2 is at least 7 degrees Celsius or at least 8 degrees Celsius, lower than the temperature of the first portion P1 during use of the system to generate aerosol.

As a result of this temperature, the second capsule 11B contents are warmed sufficiently to promote volatisation of the contents of the second capsule 11B, for instance a second aerosol modifying agent, into the aerosol formed by the system as the aerosol passes through the mouthpiece 2. Warming the content of the second capsule 11B can take place, for instance, before the second capsule 11B has been broken, such that when the second capsule 11B is broken, its contents are more readily released into the aerosol passing through the mouthpiece 2. Alternatively, the content of the second capsule 11B can be warmed to this temperature after the second capsule 11B has been broken, again resulting in the increased release of the content into the aerosol. Advantageously, mouthpiece temperatures in the range of 58 to 70 degrees Celsius have been found to be high enough that the second capsule 11B content can be more readily released, but low enough that the outer surface of the portion of the mouthpiece 2 in which the second capsule 11B is located does not reach an uncomfortable temperature for the consumer to touch in order to burst the second capsule 11B by squeezing on the mouthpiece 2.

The temperature of the first and second portions P1, P2 of the mouthpiece 2 at which the first and second capsules 11A, 11B are respectively located can be measured using a digital thermometer with a penetration probe, arranged such that the probe enters the mouthpiece 2 through a wall of the mouthpiece 2 (forming a seal to limit the amount of external air which could leak into the mouthpiece around the probe) and is located close to the location of the capsule 11. Similarly, a temperature probe can be placed on the outer surface of the mouthpiece 2 to measure the temperature of the outer surface.

In some embodiments, a heater heats the aerosol generating material 3 to generate aerosol, wherein the heater is heated to a temperature of at least 200 degrees Celsius and, preferably, at least 220, 240 or 250 degrees Celsius.

The temperature drop between the first and second portions P1, P2 of the aerosol modifying component 2 during use of the system to generate an aerosol is affected by the distance D1 between the capsules 11A, 11B, the material of the aerosol modifying component 2, and the addition of any ventilation flow at the aerosol modifying component 2.

It has been found that a larger distance D1 between the first and second capsules 11A, 11B, and thus a larger distance D1 between the first and second portions P1, P2 of the aerosol modifying component 2 in which the capsules 11A, 11B are provided, will result in a larger the temperature drop between the first and second portions P1, P2. In some embodiments, the first and second capsules 11A, 11B are spaced apart by a distance D1 of at least 7 mm and, preferably, at least 8 mm, at least 9 mm or at least 10 mm. The distance D1 between the first and second capsules 11A, 11B refers to the distance D1 between the centre of the first and second capsules 11A, 11B. In the present example, the first and second capsules 11A, 11B are spaced apart in the longitudinal direction of the aerosol modifying component, which in the present example is a mouthpiece 2.

In one embodiment, the centres of the first and second capsules 11A, 11B are spaced apart by a distance D1 of about 9 mm.

In some embodiments, the centre of the second capsule 11B is spaced at least 5 mm from the downstream end 2B of the mouthpiece 2 and, preferably, at least 6 mm, at least 7 mm or at least 8 mm.

In one embodiment, the centre of the second capsule 11B is spaced about 6 mm from the downstream end of the tubular portion 4*a*.

In some embodiments, the centre second capsule 11B is spaced at least 10 mm from the upstream end 2A of the mouthpiece 2 and, preferably, at least 11 mm, at least 12 mm, at least 13 mm or at least 14 mm. In some embodiments, the centre of the second capsule 11B is spaced up to 39 mm, up to 37 mm or up to 35 mm from the upstream end 2A of the mouthpiece 2.

In some embodiments, the centre of the second capsule 11B is spaced at least 10 mm from the downstream end of the tubular portion 4*a* and, preferably, at least 11 mm, at least 12 mm, at least 13 mm or at least 14 mm.

In some embodiments, the centre of the second capsule 11B is spaced at least 10 mm from the upstream end of the body of material 6 and, preferably, at least 11 mm, at least 12 mm, at least 13 mm or at least 14 mm.

In some embodiments, the centre of the first capsule 11A is spaced at least 12 mm from the downstream end 2B of the mouthpiece 2 and, preferably, at least 13 mm, at least 14 mm, or at least 15 mm.

In some embodiments, the centre first capsule 11A is spaced at least 2 mm from the upstream end 2A of the mouthpiece 2 and, preferably, at least 3 mm, at least 4 mm, or at least 5 mm. In some embodiments, the centre of the first capsule 11A is spaced up to 30 mm, up to 28 mm, or up to 26 mm from the upstream end 2A of the mouthpiece 2.

In some embodiments, the centre of the first capsule 11A is spaced at least 2 mm from the downstream end of the tubular portion 4*a* and, preferably, at least 3 mm, at least 4 mm, or at least 5 mm.

In some embodiments, the centre of the first capsule 11A is spaced at least 2 mm from the upstream end of the body of material 6 and, preferably, at least 3 mm, at least 4 mm, or at least 5 mm.

In one embodiment, the centre of the first capsule 11A is spaced about 5 mm from the downstream end of the tubular portion 4*a*.

In some embodiments, the first and second capsules 11A, 11B are provided in first and second bodies of material respectively (not shown) that may abut, spaced by a gap, or separated by another component such as a tube or third body of material, which may help to promote cooling of the aerosol between the first and second capsules 11A, 11B. However, in other embodiments such cooing features are omitted and instead the cooling is achieved by sufficient spacing of the first and second capsules 11A, 11B within the mouthpiece.

In other embodiments, the first and second capsules 11A, 11B are provided in a single body of material 6, which may prove easier or less expensive to manufacture than embodiments wherein the capsules are provided in separate bodies.

Providing ventilation flow into the aerosol modifying component 2 may also increase the temperature drop between the first and second portions P1, P2. For instance, the ventilation flow may be provided into the aerosol modifying component 2 downstream of the first capsule 11A but upstream of the second capsule 11B.

The ventilation flow may be provided by perforations, as will be apparent to a person skilled in the art. In other embodiments, no ventilation perforations are provided in the wrapper overlying the body of material 6, which in some embodiments may be advantageous because the ventilation flow provided by the ventilation perforations may otherwise alter the flow characteristics within the non-combustible aerosol provision system and, for example, it may instead be desirable to provide the ventilation flow in a component upstream of the body of material 6. For example, as discussed previously, in the present example, the ventilation is provided into the tubular portion 4*a*.

In one embodiment, ventilation flow is provided at between 20 and 24 mm and, preferably, 22 mm, measured axially from the mouth end 2*b*, such that the ventilation flow is into the tubular portion 4*a*. The ventilation flow may be a single or double line of ventilation holes. In some embodiments, the ventilation is between 55% and 75%, preferably between 60% and 70% and, preferably, about 65% or about 70%. This has been found to contribute to combination of an advantageous hardness and pressure drop across the mouthpiece, particularly when the first plug wrap 7 has a basis weight greater than 27 gsm and preferably, greater than 30, 35, 40, 45 or 50 gsm. In one such embodiment, the basis weight of the first plug wrap 7 is about 50 gsm.

In the present example, the first capsule 11A is positioned so that its centre is 5 mm from the upstream end of the body of material 6. In the present example, the second capsule 11B is positioned so that its centre is 6 mm from the downstream end of the body of material 6. In other examples, the first and second capsules 11A, 11B 11 can be located at other positions in the body of material 6.

The burst strength of the first and second capsules 11A, 11B can be tested using a force measuring instrument such as a Texture Analyser. For the present burst strengths, a Type TA.XTPlus Texture Analyser could be used with a circular shaped metal probe having a 6 mm diameter centred on the location of the capsule (i.e. 12 mm from the mouth end of the mouthpiece 2). The test speed of the probe could be 0.3 mm/second, while a pre-test speed of 5.00 mm/second could be used and a post-test speed of 10 mm/second. The force used is 5000 g. The articles tested can be drawn on using a Borgwaldt A14 Syringe drive Unit following the known Health Canada Intense puffing regime (55 ml puff volume applied for 2 seconds duration every 30 seconds) using standard testing equipment. Three puffs are performed using this puffing regime and the burst strength of the capsule 11A, 11B measured within 30 seconds of the third puff.

The barrier material may comprise one or more of a gelling agent, a bulking agent, a buffer, a colouring agent and a plasticiser.

Suitably, the gelling agent may be, for example, a polysaccharide or cellulosic gelling agent, a gelatin, a gum, a gel, a wax or a mixture thereof. Suitable polysaccharides include alginates, dextrans, maltodextrins, cyclodextrins and pectins. Suitable alginates include, for instance, a salt of alginic acid, an esterified alginate or glyceryl alginate. Salts of alginic acid include ammonium alginate, triethanolamine alginate, and group I or II metal ion alginates like sodium, potassium, calcium and magnesium alginate. Esterified alginates include propylene glycol alginate and glyceryl alginate. In an embodiment, the barrier material is sodium alginate and/or calcium alginate. Suitable cellulosic materials include methyl cellulose, ethyl cellulose, hydroxyethyl cellulose, hydroxypropyl cellulose, carboxymethyl cellulose, cellulose acetate and cellulose ethers. The gelling agent may comprise one or more modified starches. The gelling agent may comprise carrageenans. Suitable gums include agar, gellan gum, gum Arabic, pullulan gum, mannan gum, gum ghatti, gum tragacanth, Karaya, locust bean, acacia gum, guar, quince seed and xanthan gums. Suitable gels include agar, agarose, carrageenans, furoidan and furcellaran. Suitable waxes include carnauba wax. In some cases, the gelling agent may comprise carrageenans and/or gellan gum; these gelling agents are particularly suitable for inclusion as the gelling agent as the pressure required to break the resulting capsules is particularly suitable.

The barrier material may comprise one or more bulking agents, such as starches, modified starches (such as oxidised starches) and sugar alcohols such as maltitol.

The barrier material may comprise a colouring agent which renders easier the location of each capsule 11A, 11B within the aerosol modifying component during the manufacturing process of the aerosol modifying component. The colouring agent is preferably chosen among colorants and pigments.

The barrier material may further comprise at least one buffer, such as a citrate or phosphate compound.

The barrier material may further comprise at least one plasticiser, which may be glycerol, sorbitol, maltitol, triacetin, polyethylene glycol, propylene glycol or another polyalcohol with plasticising properties, and optionally one acid of the monoacid, diacid or triacid type, especially citric acid, fumaric acid, malic acid, and the like. The amount of plasticiser ranges from 1% to 30% by weight, preferably from 2% to 15% by weight, and even more preferably from 3 to 10% by weight of the total dry weight of the shell.

The barrier material may also comprise one or more filler materials. Suitable filler materials include comprising starch derivatives such as dextrin, maltodextrin, cyclodextrin (alpha, beta or gamma), or cellulose derivatives such as hydroxypropyl-methylcellulose (HPMC), hydroxypropylcellulose (HPC), methylcellulose (MC), carboxy-methylcellulose (CMC), polyvinyl alcohol, polyols or mixture thereof. Dextrin is a preferred filler. The amount of filler in the shell is at most 98.5%, preferably from 25 to 95% more preferably from 40 to 80% and even more preferably from 50 to 60% by weight on the total dry weight of the shell.

The shell of the first and/or second capsule 11A, 11B may additionally comprise a hydrophobic outer layer which reduces the susceptibility of the capsule 11A, 11B to moisture-induced degradation. The hydrophobic outer layer is suitably selected from the group comprising waxes, especially carnauba wax, candelilla wax or beeswax, carbowax, shellac (in alcoholic or aqueous solution), ethyl cellulose, hydroxypropyl methyl cellulose, hydroxyl-propylcellulose, latex composition, polyvinyl alcohol, or a combination thereof. More preferably, the at least one moisture barrier agent is ethyl cellulose or a mixture of ethyl cellulose and shellac.

The core of the first capsule 11A comprises an aerosol modifying agent. The core of the second capsules 11B comprises an aerosol modifying agent. The aerosol modifying agent of the first capsule 11A may be the same or different to the aerosol modifying agent of the second capsules 11B.

An aerosol-modifying agent is a substance that is configured to modify the aerosol generated, for example by changing the taste, flavour, acidity or another characteristic of the aerosol. The aerosol-modifying agent of each capsule 11A, 11B may, for example, be an additive or a sorbent. The aerosol-modifying agent of each capsule 11A, 11B may, for example, comprise one or more of a flavourant, a colourant, water, and a carbon adsorbent. The aerosol-modifying agent of each capsule 11A, 11B may, for example, be a solid, a liquid, or a gel. The aerosol-modifying agent of each capsule 11A, 11B may be in powder, thread or granule form. The aerosol-modifying agent of each capsule 11A, 11B may be free from filtration material.

In some cases, the first and/or second capsule 11A, 11B may comprise at least about 25% w/w flavourant (based on the total weight of the capsule), suitably at least about 30% w/w flavourant, 35% w/w flavourant, 40% w/w flavourant, 45% w/w flavourant or 50% w/w flavourant.

In some cases, the core the first and/or second capsule 11A, 11B may comprise at least about 25% w/w flavourant (based on the total weight of the core), suitably at least about 30% w/w flavourant, 35% w/w flavourant, 40% w/w flavourant, 45% w/w flavourant or 50% w/w flavourant. In some cases, the core the first and/or second capsule 11A, 11B may comprise less than or equal to about 75% w/w flavourant (based on the total weight of the core), suitably less than or equal to about 65% w/w flavourant, 55% w/w flavourant, or 50% w/w flavourant. Illustratively, the first and/or second capsule 11A, 11B may include an amount of flavourant in the range of 25-75% w/w (based on the total weight of the core), about 35-60% w/w or about 40-55% w/w.

The first and/or second capsule 11A, 11B may each include at least about 2 mg, 3 mg or 4 mg of aerosol modifying agent, suitably at least about 4.5 mg of aerosol modifying agent, 5 mg of aerosol modifying agent, 5.5 mg of aerosol modifying agent or 6 mg of aerosol modifying agent.

In some cases, the consumable comprises at least about 7 mg of aerosol modifying agent, suitably at least about 8 mg of aerosol modifying agent, 10 mg of aerosol modifying agent, 12 mg of aerosol modifying agent or 15 mg of aerosol modifying agent. The core of the first and/or second capsule 11A, 11B may also comprise a solvent which dissolves the aerosol modifier.

Any suitable solvent may be used.

Where the aerosol modifying agent of the first and/or second capsule 11A, 11B comprises a flavourant, the solvent may suitably comprise short or medium chain fats and oils. For example, the solvent may comprise tri-esters of glycerol such as C2-C12 triglycerides, suitably C6-C10 triglycerides or Cs-C12 triglycerides. For example, the solvent may comprise medium chain triglycerides (MCT-C8-C12), which may be derived from palm oil and/or coconut oil.

The esters may be formed with caprylic acid and/or capric acid. For example, the solvent may comprise medium chain triglycerides which are caprylic triglycerides and/or capric tryglycerides. For example, the solvent may comprise compounds identified in the CAS registry by numbers 73398-61-5, 65381-09-1, 85409-09-2. Such medium chain triglycerides are odourless and tasteless.

The hydrophilic-lipophilic balance (HLB) of the solvent may be in the range of 9 to 13, suitably 10 to 12. Methods of making the capsules 11A, 11B include co-extrusion, optionally followed by centrifugation and curing and/or drying. The contents of WO 2007/010407 A2 is incorporated by reference, in its entirety.

As explained previously, when the aerosol generating material 3 is heated to provide an aerosol, for instance within a non-combustible aerosol provision device as described herein, the second portion P2 of the mouthpiece 2 in which the second capsule 11B is located reaches a temperature of at least 4 degrees Celsius lower than the temperature at the first portion P1 of the mouthpiece 2 during use of the system to generate an aerosol. In some embodiments, the second portion P2 reaches a temperature that is at least 5, 6, 7, 8, 9 or 10 degrees Celsius lower than the temperature at the first portion P1 of the mouthpiece 2 during use of the system to generate an aerosol.

The aerosol-modifying agent of the second capsule 11B is therefore heated to a lower temperature than the aerosol-modifying agent of the first capsule 11A.

In some embodiments, the first and second capsules 11A, 11B have the same aerosol-modifying profiles, meaning that both capsules 11A, 11B contain the same amount and type of aerosol-modifying agent and in the same amount such that if both capsules 11A, 11B were heated to the same temperature and broken then both capsules 11A, 11B would cause the same modification of the aerosol. However, since the first capsule 11A is heated to a higher temperature than the second capsule 11B, more of the aerosol-modifying agent of the first capsule 11A will be, for example, volatised compared to the modifying agent of the second capsule 11B and thus will cause a more pronounced modification of the aerosol than the second capsule 11B. Therefore, despite both capsules 11A, 11B being the same, which may make the aerosol modifying component easier and/or less expensive to manufacture, the user can decide whether to break the first capsule 11A to cause a more pronounced modification of the aerosol, or the second capsule 11B to cause a less pronounced modification of the aerosol, or both capsules 11A, 11B to cause the greatest modification of the aerosol.

For example, both the first and second capsules 11A, 11B may have the same flavourant and in the same amounts. If the user breaks the first capsules 11A, then the flavourant will be more quickly volatised by the hotter temperature in comparison to if the second capsule 11B was broken. Alternatively, the user may decide to break both capsules 11A, 11B to deliver the greatest amount of flavourant to the aerosol.

In some embodiments, the first and second capsules 11A, 11B both comprise first and second aerosol modifying agents. The first aerosol modifying agent has a lower vapour pressure than the second aerosol modifying agent. Thus, when the second capsule 11B is broken, a greater proportion of the second aerosol modifying agent will be vapourised relative to the first aerosol modifying agent in comparison to when the hotter first capsule 11A is broken during use of the system to generate aerosol. Therefore, the same capsule 11A, 11B can be used to generate different modifications of the aerosol based on the position of the capsule 11A, 11B in the first or second portion P1, P2 of the mouthpiece 2.

In some embodiments, the first capsule 11A comprises a first aerosol modifying agent and the second capsule 11B comprises a different second aerosol modifying agent. Optionally, the first aerosol modifying agent has a lower vapour pressure than the second aerosol modifying agent. If the first and second capsules 11A, 11B were heated to the same temperature, then the higher vapour pressure of the second aerosol modifying agent would mean that a greater amount of the second aerosol modifying agent would is be volatised relative to the first aerosol modifying agent. However, since the second capsule 11B is heated to a lower temperature, this effect is less pronounced such that a more even amount of the first and second aerosol modifying agents are volatised upon breaking of the first and second capsules 11A, 11B respectively.

In some embodiments, one or both of the capsules 11A, 11B comprises at least one, at least two, at least three or at least four aerosol modifying agents. In some embodiments, one or more of the aerosol modifying agents of one of the first and second capsules 11A, 11B has a different vapour pressure to an aerosol modifying agent of the other one of the first and second capsules 11A, 11B.

In the examples described above, the mouthpiece 2 comprises a single body of material 6. In other examples, the mouthpiece 2 may include multiple bodies of material. The mouthpiece 2 may comprise a cavity between the bodies of material.

In some examples, the mouthpiece 2 downstream of the aerosol generating material 3 can comprise a wrapper, for instance the first or second plug wraps 7, 9, or tipping paper 5, which comprises an aerosol modifying agent as described herein or other sensate material. The aerosol modifying agent may be disposed on an inwardly or outwardly facing surface of the mouthpiece wrapper. For instance, the aerosol modifying agent or other sensate material may be provided on an area of the wrapper, such as an outwardly facing surface of the tipping paper 5, which comes into contact with the consumer's lips during use. By disposing an aerosol modifying agent or other sensate material on the outwardly facing surface of the mouthpiece wrapper, the aerosol modifying agent or other sensate material may be transferred to the consumer's lips during use. Transfer of the aerosol modifying agent or other sensate material to the consumer's lips during use of the article may modify the organoleptic properties (e.g. taste) of the aerosol generated by the aerosol generating substrate 3 or otherwise provide the consumer with an alternative sensory experience. For example, the aerosol modifying agent or other sensate material may impart flavour to the aerosol generated by the aerosol generating substrate 3. The aerosol modifying agent or other sensate material may be at least partially soluble in water such that it is transferred to the user via the consumer's saliva. The aerosol modifying agent or other sensate material may be one that volatilises by the heat generated by the aerosol provision system. This may facilitate transfer of the aerosol modifying agent to the aerosol generated by the aerosol generating substrate 3. A suitable sensate material may be a flavour as described herein, sucralose or a cooling agent such as menthol or similar.

In some embodiments, a non-combustible aerosol provision system is provided comprising an aerosol modifying component and a heater which, in use, is operable to heat the aerosol generating material 3 such that the aerosol generating material 3 provides an aerosol. The aerosol modifying component may comprise a capsule. In some embodiments, the aerosol modifying component comprises first and second capsules. The first capsule is disposed in a first portion of the aerosol modifying component and the second capsule is disposed in a second portion of the aerosol modifying component downstream of the first portion.

The first portion of the aerosol modifying component is heated to a first temperature during operation of the heater to generate the aerosol and the second portion is heated to a second temperature during operation of the heater to generate aerosol, wherein the second temperature is at least 4 degrees Celsius lower than the first temperature. Preferably, the second temperature is at least 5, 6, 7, 8, 9 or 10 degrees Celsius lower than the first temperature.

The aerosol modifying component may comprise one or more components of the article 1. In some embodiments, the aerosol modifying component comprises the body of material 6, wherein the first and second capsules are disposed in the body of material 6. The body of material 6 may comprise cellulose acetate. In another embodiment, the aerosol modifying component comprises two bodies of material (not shown), wherein the first and second capsules are disposed in the first and second bodies respectively. In some embodiments, the aerosol modifying component alternatively or additionally comprises one or more tubular elements upstream and/or downstream of the body or bodies of material. The aerosol generating component may comprise the mouthpiece 2, 2'.

In some embodiments, the second capsule is spaced from the first capsule by a distance of at least 7 mm, measured as the distance between the centre of the first and second capsules. Preferably, the second capsule is spaced from the first capsule by a distance of at least 8, 9 or 10 mm. It has been found that increasing the distance between the first and second capsules increases the difference between the first and second temperatures.

The first capsule comprises an aerosol modifying agent. The second capsule comprises an aerosol modifying agent which may be the same or different as the aerosol modifying agent of the first capsule. In some embodiments, a user may selectively rupture the first and second capsules by applying an external force to the aerosol modifying component in order to release the aerosol modifying agent from each capsule.

The aerosol-modifying agent of the second capsule is heated to a lower temperature than the aerosol-modifying agent of the first capsule due to the difference between the first and second temperatures.

The aerosol-modifying agents of the first and second capsules can be selected based on this temperature difference. For instance, the first capsule may comprise a first aerosol modifying agent that has a lower vapour pressure than a second aerosol modifying agent of the second capsule. If the capsules were both heated to the same temperature, then the higher vapour pressure of the aerosol modifying agent of the second capsule would mean that a greater amount of the second aerosol modifying agent would be volatised relative to the aerosol modifying agent of the first capsule. However, since the second capsule is heated to a lower temperature, this effect is less pronounced such that a more even amount of the aerosol modifying agents of the first and second capsules are volatised upon breaking of the first and second capsules respectively.

In some embodiments, the first and second capsules have the same aerosol-modifying profiles, meaning that both capsules contain the same type of aerosol-modifying agent and in the same amount such that if both capsules were heated to the same temperature and broken then both capsules would cause the same modification of the aerosol. However, since the first capsule is heated to a higher temperature than the second capsule, more of the aerosol-modifying agent of the first capsule will be, for example, volatised compared to the modifying agent of the second capsule and thus will cause a more pronounced modification of the aerosol than the second capsule. Therefore, despite both capsules being the same, which may make the aerosol modifying component easier and/or less expensive to manufacture, the user can decide whether to break the first capsule to cause a more pronounced modification of the aerosol, or the second capsule to cause a less pronounced modification of the aerosol, or both capsules to cause the greatest modification of the aerosol.

In some embodiments, the first and second capsules both comprise first and second is aerosol modifying agents. The first aerosol modifying agent has a lower vapour pressure than the second aerosol modifying agent. Thus, when the second capsule is broken, a greater proportion of the second aerosol modifying agent will be vaporised relative to the first aerosol modifying agent in comparison to when the hotter first capsule is broken during use of the system to generate aerosol. Therefore, the same capsule can be used to generate different modifications of the aerosol based on the position of the capsule in the first or second portion of the aerosol modifying component.

A non-combustible aerosol provision device is used to heat the aerosol generating material 3 of the article 1 described herein. The non-combustible aerosol provision device preferably comprises a coil, since this has been found to enable improved heat transfer to the article 1 as compared to other arrangements.

In some examples, the coil is configured to, in use, cause heating of at least one electrically-conductive heating element, so that heat energy is conductible from the at least one electrically-conductive heating element to the aerosol generating material to thereby cause heating of the aerosol generating material.

In some examples, the coil is configured to generate, in use, a varying magnetic field for penetrating at least one heating element, to thereby cause induction heating and/or magnetic hysteresis heating of the at least one heating element. In such an arrangement, the or each heating element may be termed a "susceptor" as defined herein. A coil that is configured to generate, in use, a varying magnetic field for penetrating at least one electrically-conductive heating element, to thereby cause induction heating of the at least one electrically-conductive heating element, may be termed an "induction coil" or "inductor coil".

The device may include the heating element(s), for example electrically-conductive heating element(s), and the heating element(s) may be suitably located or locatable relative to the coil to enable such heating of the heating element(s). The heating element(s) may be in a fixed position relative to the coil. Alternatively, the at least one heating element, for example at least one electrically-conductive heating element, may be included in the article 1 for insertion into a heating zone of the device, wherein the article 1 also comprises the aerosol generating material 3 and is removable from the heating zone after use. Alternatively, both the device and such an article 1 may comprise at least one respective heating element, for example at least one electrically-conductive heating element, and the coil may be to cause heating of the heating element(s) of each of the device and the article when the article is in the heating zone.

In some examples, the coil is helical. In some examples, the coil encircles at least a part of a heating zone of the device that is configured to receive aerosol generating material. In some examples, the coil is a helical coil that encircles at least a part of the heating zone.

In some examples, the device comprises an electrically-conductive heating element that at least partially surrounds the heating zone, and the coil is a helical coil that encircles at least a part of the electrically-conductive heating element. In some examples, the electrically-conductive heating element is tubular. In some examples, the coil is an inductor coil.

In some examples, the use of a coil enables the non-combustible aerosol provision device to reach operational temperature more quickly than a non-coil aerosol provision device. For instance, the non-combustible aerosol provision device including a coil as described above can reach an operational temperature such that a first puff can be provided in less than 30 seconds from initiation of a device heating program, more preferably in less than 25 seconds. In some examples, the device can reach an operational temperature in about 20 seconds from the initiation of a device heating program.

The use of a coil as described herein in the device to cause heating of the aerosol generating material has been found to enhance the aerosol which is produced. For instance, consumers have reported that the aerosol generated by a device including a coil such as that described herein is sensorially closer to that generated in factory made cigarette (FMC) products than the aerosol produced by other non-combustible aerosol provision systems. Without wishing to be bound by theory, it is hypothesised that this is the result of the reduced time to reach the required heating temperature when the coil is used, the higher heating temperatures achievable when the coil is used and/or the fact that the coil enables such systems to simultaneously heat a relatively large volume of aerosol generating material, resulting in aerosol temperatures resembling FMC aerosol temperatures. In FMC products, the burning coal generates a hot aerosol which heats tobacco in the tobacco rod behind the coal, as the aerosol is drawn through is the rod. This hot aerosol is understood to release flavour compounds from tobacco in the rod behind the burning coal. A device including a coil as described herein is thought to also be capable of heating aerosol generating material, such as tobacco material described herein, to release flavour compounds, resulting in an aerosol which has been reported to more closely resemble an FMC aerosol. Particular improvements in aerosol can be achieved through the use of a device including a coil to heat an article comprising a rod of aerosol generating material having a circumference greater than 19 mm, for instance a circumference between about 19 mm and about 23 mm.

Using an aerosol provision system including a coil as described herein, for instance an induction coil which heats at least some of the aerosol generating material to at least 200° C., more preferably at least 220° C., can enable the generation of an aerosol from an aerosol generating material that has particular characteristics which are thought to more closely resemble those of an FMC product. For example, when heating an aerosol generating material, including nicotine, using an induction heater, heated to at least 250° C., for a two-second period, under an airflow of at least 1.50 L/m during the period, one or more of the following characteristics has been observed:

- at least 10 μg of nicotine is aerosolised from the aerosol generating material;
- the weight ratio in the generated aerosol, of aerosol-former material to nicotine is at least about 2.5:1, suitably at least 8.5:1;
- at least 100 μg of the aerosol-former material can be aerosolised from the aerosol generating material;
- the mean particle or droplet size in the generated aerosol is less than about 1000 nm; and
- the aerosol density is at least 0.1 μg/cc.

In some cases, at least 10 μg of nicotine, suitably at least 30 μg or 40 μg of nicotine, is aerosolised from the aerosol generating material under an airflow of at least 1.50 L/m during the period. In some cases, less than about 200 μg, suitably less than about 150 μg or less than about 125 μg, of nicotine is aerosolised from the aerosol generating material under an airflow of at least 1.50 L/m during the period.

In some cases, the aerosol contains at least 100 μg of the aerosol-former material, suitably at least 200 μg, 500 μg or 1 mg of aerosol-former material is aerosolised from the aerosol generating material under an airflow of at least 1.50 L/m during the period. Suitably, the aerosol-former material may comprise or consist of glycerol.

As defined herein, the term "mean particle or droplet size" refers to the mean size of the solid or liquid components of an aerosol (i.e. the components suspended in a gas). Where the aerosol contains suspended liquid droplets and suspended solid particles, the term refers to the mean size of all components together.

In some cases, the mean particle or droplet size in the generated aerosol may be less than about 900 nm, 800 nm, 700, nm 600 nm, 500 nm, 450 nm or 400 nm. In some cases, the mean particle or droplet size may be more than about 25 nm, 50 nm or 100 nm.

In some cases, the aerosol density generated during the period is at least 0.1 μg/cc. In some cases, the aerosol density is at least 0.2 μg/cc, 0.3 μg/cc or 0.4 μg/cc. In some cases, the aerosol density is less than about 2.5 μg/cc, 2.0 μg/cc, 1.5 μg/cc or 1.0 μg/cc.

The non-combustible aerosol provision device is preferably arranged to heat the aerosol generating material 3 of the article 1, to a maximum temperature of at least 160° C. Preferably, the non-combustible aerosol provision device is arranged to heat the aerosol-former material 3 of the article 1, to a maximum temperature of at least about 200° C., or at least about 220° C., or at least about 240° C., more preferably at least about 270° C., at least once during the heating process followed by the non-combustible aerosol provision device.

Using an aerosol provision system including a coil as described herein, for instance an induction coil which heats at least some of the aerosol generating material to at least 200° C., more preferably at least 220° C., can enable the generation of an aerosol from an aerosol generating material in an article 1 as described herein that has a higher temperature as the aerosol leaves the mouth end of the mouthpiece 2' than previous devices, contributing to the generation of an aerosol which is considered closer to an FMC product.

In some embodiments, the maximum aerosol temperature measured at the mouth-end of the article 1 can preferably be less than 62° C., more preferably less than 60° C. and still more preferably less than 55° C. or 50° C. or 47.5° C. In some embodiments, the maximum aerosol temperature measured at the mouth-end of the article 1 can preferably be between 35° C. and 55° C., more preferably between 40° C. and 55° C. or 40° C. and 50° C.

FIG. 2 shows an example of a non-combustible aerosol provision device 100 for generating aerosol from an aerosol generating medium/material such as the aerosol generating material 3 of the article 1 described herein. In broad outline, the device 100 may be used to heat a replaceable article 110 comprising the aerosol generating medium, for instance the article 1 described herein, to generate an aerosol or other inhalable medium which is inhaled by a user of the device 100. The device 100 and replaceable article 110 together form a system.

The device 100 comprises a housing 102 (in the form of an outer cover) which surrounds and houses various components of the device 100. The device 100 has an opening 104 in one end, through which the article 110 may be inserted for heating by a heating assembly. In use, the article 110 may be fully or partially inserted into the heating assembly where it may be heated by one or more components of the heater assembly.

When the article 110 is inserted into the device 100, the minimum distance between the one or more components of the heater assembly and a tubular body 4*a* of the article 110 may be in the range 3 mm to 10 mm, for example 3 mm, 4 mm, 5 mm, 6 mm, 7 mm, 8 mm, 9 mm or 10 mm.

Figure 3:
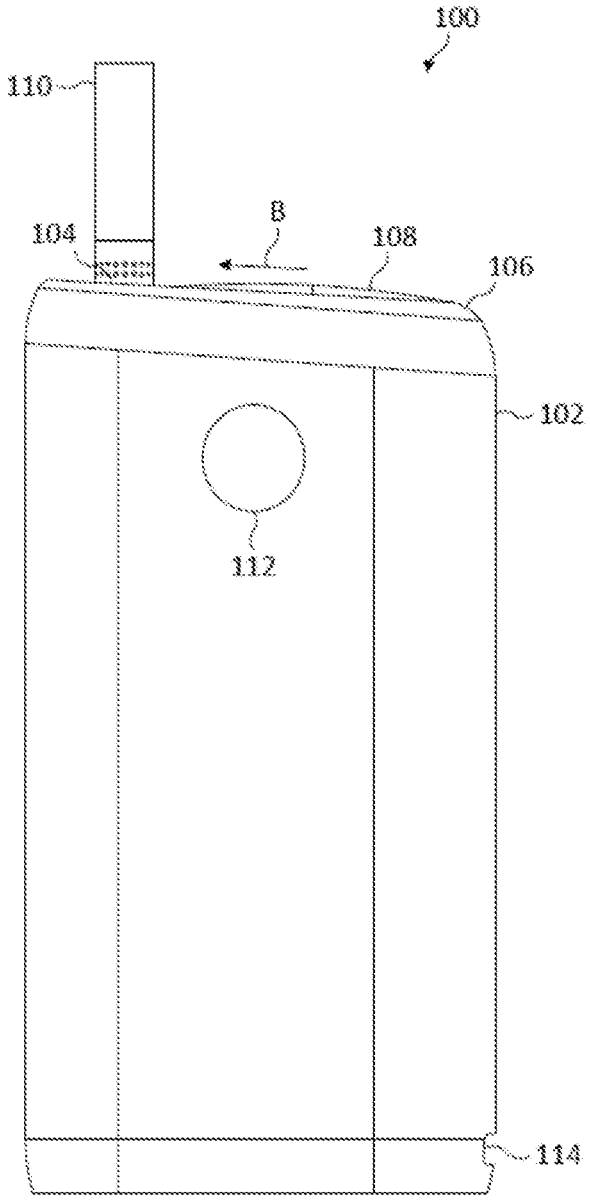
FIG. 3 is a perspective illustration of a non-combustible aerosol provision device for generating aerosol from the aerosol generating material of the article of FIGS. 1 and 2.

The device 100 of this example comprises a first end member 106 which comprises a lid 108 which is movable relative to the first end member 106 to close the opening 104 when no article 110 is in place. In FIG. 3, the lid 108 is shown in an open configuration, however the lid 108 may move into a closed configuration. For example, a user may cause the lid 108 to slide in the direction of arrow "B".

The device 100 may also include a user-operable control element 112, such as a button or switch, which operates the device 100 when pressed. For example, a user may turn on the device 100 by operating the switch 112.

The device 100 may also comprise an electrical component, such as a socket/port 114, which can receive a cable to charge a battery of the device 100. For example, the socket 114 may be a charging port, such as a USB charging port.

Figure 4:
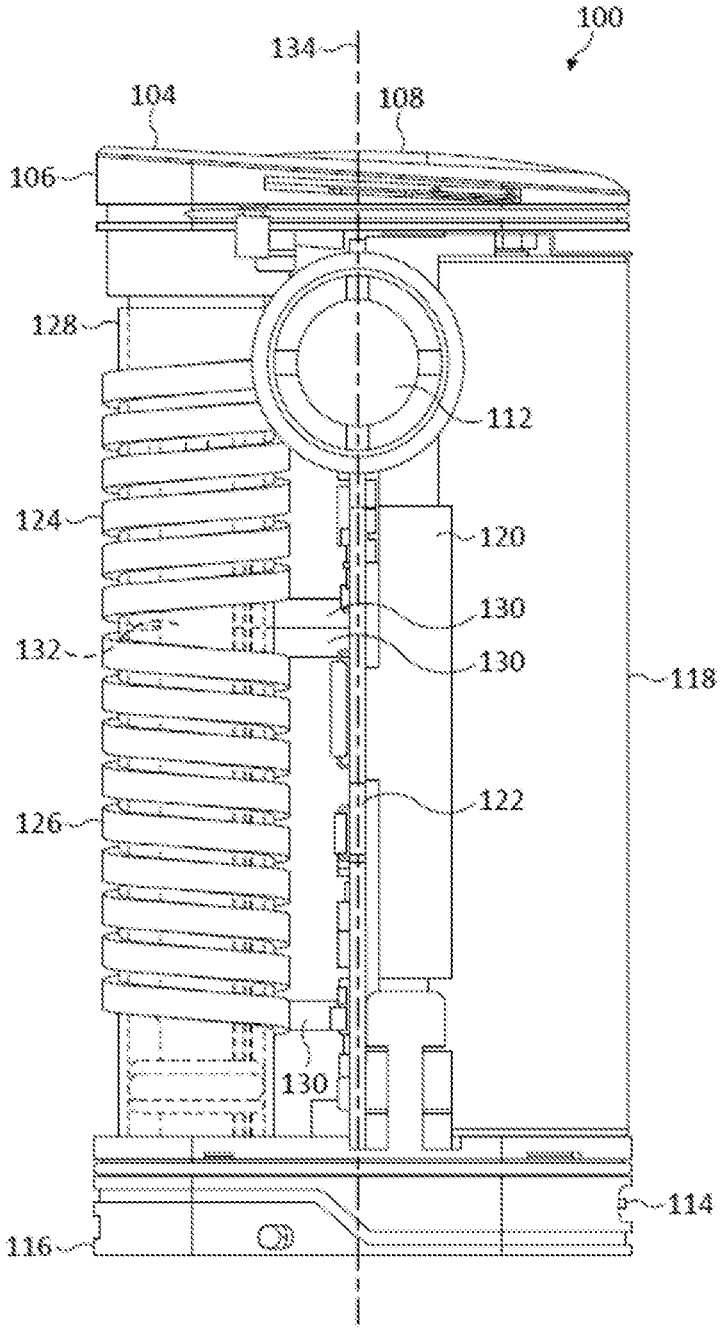
FIG. 4 illustrates the device of FIG. 3 with the outer cover removed and without an article present.

FIG. 4 depicts the device 100 of FIG. 3 with the outer cover 102 removed and without an article 110 present. The device 100 defines a longitudinal axis 134.

As shown in FIG. 4, the first end member 106 is arranged at one end of the device 100 and a second end member 116 is arranged at an opposite end of the device 100. The first and second end members 106, 116 together at least partially define end surfaces of the device 100. For example, the bottom surface of the second end member 116 at least partially defines a bottom surface of the device 100. Edges of the outer cover 102 may also define a portion of the end surfaces. In this example, the lid 108 also defines a portion of a top surface of the device 100.

The end of the device closest to the opening 104 may be known as the proximal end (or mouth end) of the device 100 because, in use, it is closest to the mouth of the user. In use, a user inserts an article 110 into the opening 104, operates the user control 112 to begin heating the aerosol generating material and draws on the aerosol generated in the device. This causes the aerosol to flow through the device 100 along a flow path towards the proximal end of the device 100.

The other end of the device furthest away from the opening 104 may be known as the distal end of the device 100 because, in use, it is the end furthest away from the mouth of the user. As a user draws on the aerosol generated in the device, the aerosol flows away from the distal end of the device 100.

The device 100 further comprises a power source 118. The power source 118 may be, for example, a battery, such as a rechargeable battery or a non-rechargeable battery. Examples of suitable batteries include, for example, a lithium battery (such as a lithium-ion battery), a nickel battery (such as a nickel-cadmium battery), and an alkaline battery. The battery is electrically coupled to the heating assembly to supply electrical power when required and under control of a controller (not shown) to heat the aerosol generating material. In this example, the battery is connected to a central support 120 which holds the battery 118 in place.

The device further comprises at least one electronics module 122. The electronics module 122 may comprise, for example, a printed circuit board (PCB). The PCB 122 may support at least one controller, such as a processor, and memory. The PCB 122 may also comprise one or more electrical tracks to electrically connect together various electronic components of the device 100. For example, the battery terminals may be electrically connected to the PCB 122 so that power can be distributed throughout the device 100. The socket 114 may also be electrically coupled to the battery via the electrical tracks.

In the example device 100, the heating assembly is an inductive heating assembly and comprises various components to heat the aerosol generating material of the article 110 via an inductive heating process. Induction heating is a process of heating an electrically conducting object (such as a susceptor) by electromagnetic induction. An induction heating assembly may comprise an inductive element, for example, one or more inductor coils, and a device for passing a varying electric current, such as an alternating electric current, through the inductive element. The varying electric current in the inductive element produces a varying magnetic field. The varying magnetic field penetrates a susceptor suitably positioned with respect to the inductive element, and generates eddy currents inside the susceptor. The susceptor has electrical resistance to the eddy currents, and hence the flow of the eddy currents against this resistance causes the susceptor to be heated by Joule heating. In cases where the susceptor comprises ferromagnetic material such as iron, nickel or cobalt, heat may also be generated by magnetic hysteresis losses in the susceptor, i.e. by the varying orientation of magnetic dipoles in the magnetic material as a result of their alignment with the varying magnetic field. In inductive heating, as compared to heating by conduction for example, heat is generated inside the susceptor, allowing for rapid heating. Further, there need not be any physical contact between the inductive heater and the susceptor, allowing for enhanced freedom in construction and application.

The induction heating assembly of the example device 100 comprises a susceptor arrangement 132 (herein referred to as "a susceptor"), a first inductor coil 124 and a second inductor coil 126. The first and second inductor coils 124, 126 are made from an electrically conducting material. In this example, the first and second inductor coils 124, 126 are made from Litz wire/cable which is wound in a helical fashion to provide helical inductor coils 124, 126. Litz wire comprises a plurality of individual wires which are individually insulated and are twisted together to form a single wire. Litz wires are designed to reduce the skin effect losses in a conductor. In the example device 100, the first and second inductor coils 124, 126 are made from copper Litz wire which has a rectangular cross section. In other examples the Litz wire can have other shape cross sections, such as circular.

The first inductor coil 124 is configured to generate a first varying magnetic field for heating a first section of the susceptor 132 and the second inductor coil 126 is configured to generate a second varying magnetic field for heating a second section of the susceptor 132. In this example, the first inductor coil 124 is adjacent to the second inductor coil 126 in a direction along the longitudinal axis 134 of the device 100 (that is, the first and second inductor coils 124, 126 to not overlap). The susceptor arrangement 132 may comprise a single susceptor, or two or more separate susceptors. Ends 130 of the first and second inductor coils 124, 126 can be connected to the PCB 122.

It will be appreciated that the first and second inductor coils 124, 126, in some examples, may have at least one characteristic different from each other. For example, the first inductor coil 124 may have at least one characteristic different from the second inductor coil 126. More specifically, in one example, the first inductor coil 124 may have a different value of inductance than the second inductor coil 126. In FIG. 4, the first and second inductor coils 124, 126 are of different lengths such that the first inductor coil 124 is wound over a smaller section of the susceptor 132 than the second inductor coil 126. Thus, the first inductor coil 124 may comprise a different number of turns than the second inductor coil 126 (assuming that the spacing between individual turns is substantially the same). In yet another example, the first inductor coil 124 may be made from a different material to the second inductor coil 126. In some examples, the first and second inductor coils 124, 126 may be substantially identical.

In this example, the first inductor coil 124 and the second inductor coil 126 are wound in opposite directions. This can be useful when the inductor coils are active at different times. For example, initially, the first inductor coil 124 may be operating to heat a first section/portion of the article 110, and at a later time, the second inductor coil 126 may be operating to heat a second section/portion of the article 110. Winding the coils in opposite directions helps reduce the current induced in the inactive coil when used in conjunction with a particular type of control circuit. In FIG. 4, the first inductor coil 124 is a right-hand helix and the second inductor coil 126 is a left-hand helix. However, in another embodiment, the inductor coils 124, 126 may be wound in the same direction, or the first inductor coil 124 may be a left-hand helix and the second inductor coil 126 may be a right-hand helix.

The susceptor 132 of this example is hollow and therefore defines a receptacle within which aerosol generating material is received. For example, the article 110 can be inserted into the susceptor 132. In this example the susceptor 120 is tubular, with a circular cross section.

The susceptor 132 may be made from one or more materials. Preferably the susceptor 132 comprises carbon steel having a coating of Nickel or Cobalt.

In some examples, the susceptor 132 may comprise at least two materials capable of being heated at two different frequencies for selective aerosolization of the at least two materials. For example, a first section of the susceptor 132 (which is heated by the first inductor coil 124) may comprise a first material, and a second section of the susceptor 132 which is heated by the second inductor coil 126 may comprise a second, different material. In another example, the first section may comprise first and second materials, where the first and second materials can be heated differently based upon operation of the first inductor coil 124. The first and second materials may be adjacent along an axis defined by the susceptor 132, or may form different layers within the susceptor 132. Similarly, the second section may comprise third and fourth materials, where the third and fourth materials can be heated differently based upon operation of the second inductor coil 126. The third and fourth materials may be adjacent along an axis defined by the susceptor 132, or may form different layers within the susceptor 132. Third material may the same as the first material, and the fourth material may be the same as the second material, for example. Alternatively, each of the materials may be different. The susceptor may comprise carbon steel or aluminium for example.

The device 100 of FIG. 4 further comprises an insulating member 128 which may be generally tubular and at least partially surround the susceptor 132. The insulating member 128 may be constructed from any insulating material, such as plastic for example. In this particular example, the insulating member is constructed from polyether ether ketone (PEEK). The insulating member 128 may help insulate the various components of the device 100 from the heat generated in the susceptor 132.

Figure 5:
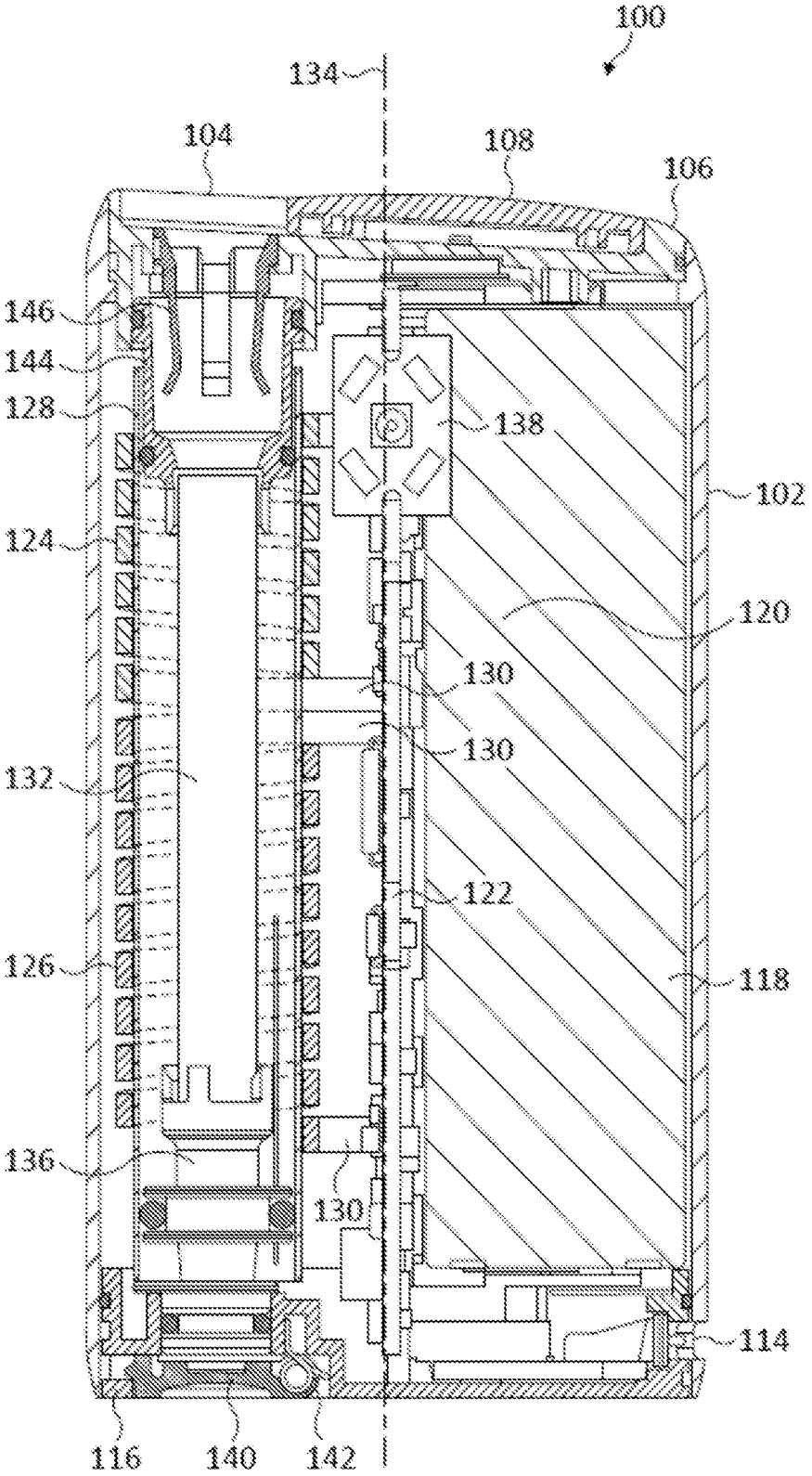
FIG. 5 is a side view of the device of FIG. 3 in partial cross-section.

The insulating member 128 can also fully or partially support the first and second inductor coils 124, 126. For example, as shown in FIG. 5, the first and second inductor coils 124, 126 are positioned around the insulating member 128 and are in contact with a radially outward surface of the insulating member 128. In some is examples the insulating member 128 does not abut the first and second inductor coils 124, 126. For example, a small gap may be present between the outer surface of the insulating member 128 and the inner surface of the first and second inductor coils 124, 126.

In a specific example, the susceptor 132, the insulating member 128, and the first and second inductor coils 124, 126 are coaxial around a central longitudinal axis of the susceptor 132.

FIG. 5 shows a side view of device 100 in partial cross-section. The outer cover 102 is present in this example. The rectangular cross-sectional shape of the first and second inductor coils 124, 126 is more clearly visible.

The device 100 further comprises a support 136 which engages one end of the susceptor 132 to hold the susceptor 132 in place. The support 136 is connected to the second end member 116.

The device may also comprise a second printed circuit board 138 associated within the control element 112.

The device 100 further comprises a second lid/cap 140 and a spring 142, arranged towards the distal end of the device 100. The spring 142 allows the second lid 140 to be opened, to provide access to the susceptor 132. A user may open the second lid 140 to clean the susceptor 132 and/or the support 136.

The device 100 further comprises an expansion chamber 144 which extends away from a proximal end of the susceptor 132 towards the opening 104 of the device. Located at least partially within the expansion chamber 144 is a retention clip 146 to abut and hold the article 110 when received within the device 100. The expansion chamber 144 is connected to the end member 106.

Figure 6:
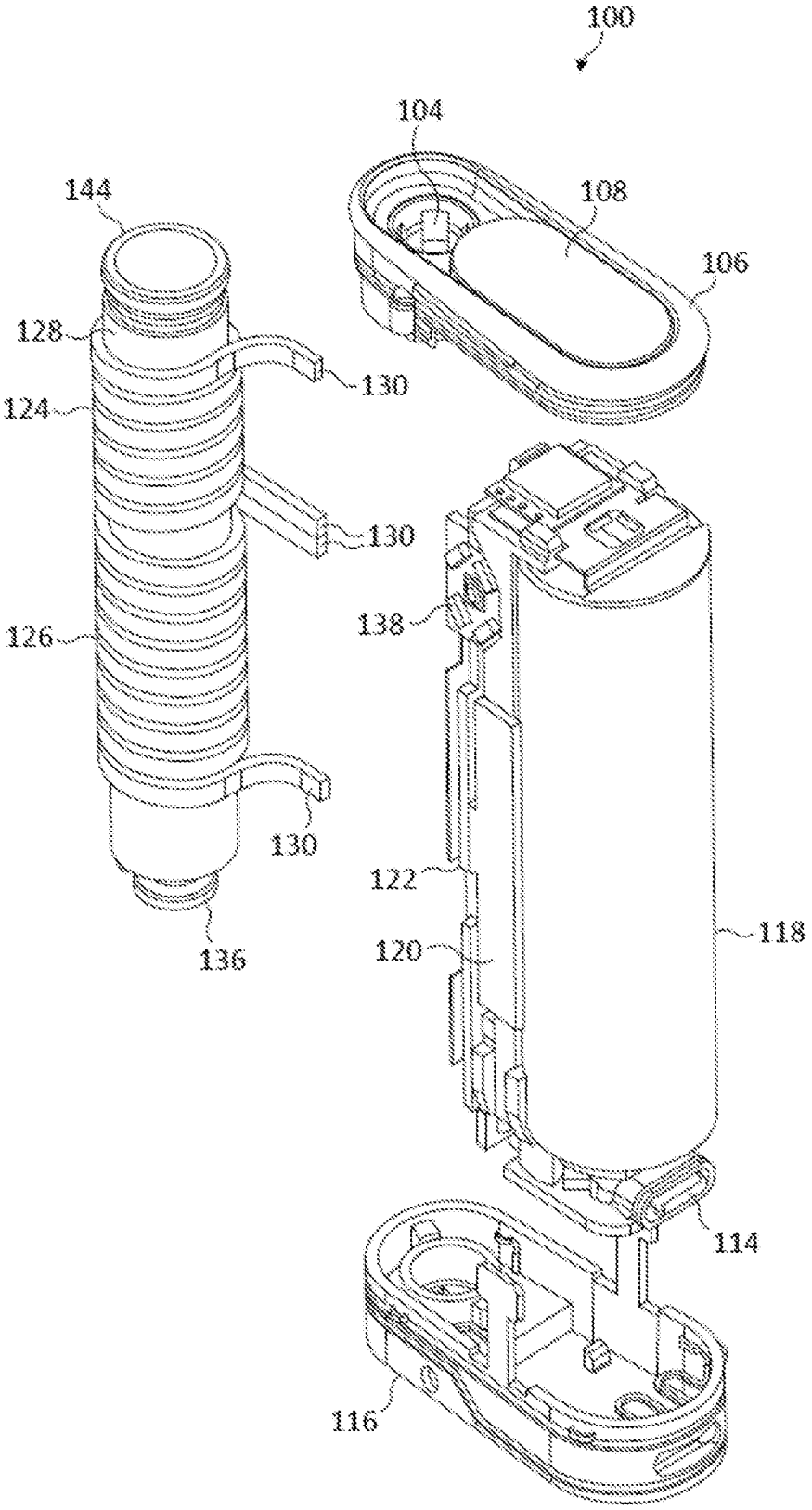
FIG. 6 is an exploded view of the device of FIG. 3, with the outer cover omitted.

FIG. 6 is an exploded view of the device 100 of FIG. 5, with the outer cover 102 omitted.

Figure 7A:
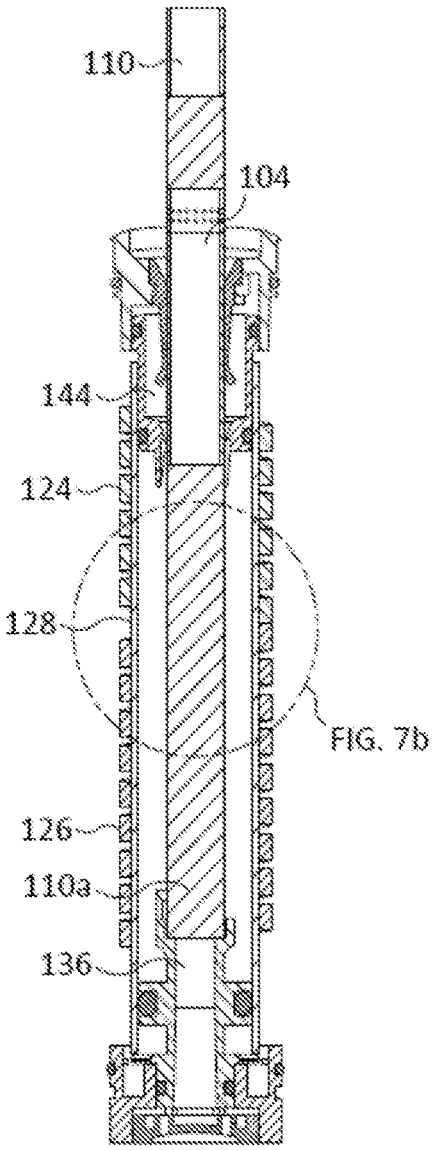
FIG. 7A is a cross sectional view of a portion of the device of FIG. 3; and, FIG. 7B is a close-up illustration of a region of the device of FIG. 7A.
Figure 7B:
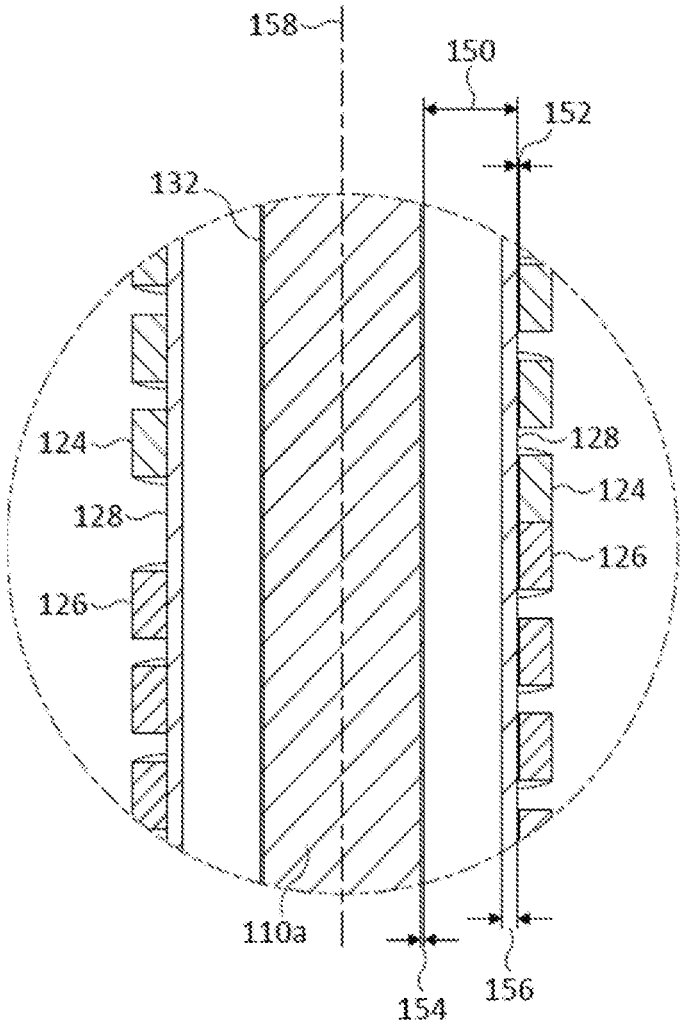

FIG. 7A depicts a cross section of a portion of the device 100 of FIG. 5. FIG. 7B depicts a close-up of a region of FIG. 7A. FIGS. 7A and 7B show the article 110 received within the susceptor 132, where the article 110 is dimensioned so that the outer surface of the article 110 abuts the inner surface of the susceptor 132. This ensures that the heating is most efficient. The article 110 of this example comprises aerosol generating material 110*a*. The aerosol generating material 110*a* is positioned within the susceptor 132. The article 110 may also comprise other components such as a filter, wrapping materials and/or a cooling structure.

FIG. 7B shows that the outer surface of the susceptor 132 is spaced apart from the inner surface of the inductor coils 124, 126 by a distance 150, measured in a direction perpendicular to a longitudinal axis 158 of the susceptor 132. In one particular example, the distance 150 is about 3 mm to 4 mm, about 3-3.5 mm, or about 3.25 mm.

FIG. 7B further shows that the outer surface of the insulating member 128 is spaced apart from the inner surface of the inductor coils 124, 126 by a distance 152, measured in a direction perpendicular to a longitudinal axis 158 of the susceptor 132. In one particular example, the distance 152 is about 0.05 mm. In another example, the distance 152 is substantially 0 mm, such that the inductor coils 124, 126 abut and touch the insulating member 128.

In one example, the susceptor 132 has a wall thickness 154 of about 0.025 mm to 1 mm, or about 0.05 mm.

In one example, the susceptor 132 has a length of about 40 mm to 60 mm, about 40 mm to 45 mm, or about 44.5 mm.

In one example, the insulating member 128 has a wall thickness 156 of about 0.25 mm to 2 mm, 0.25 mm to 1 mm, or about 0.5 mm.

In use, the article 1 described herein can be inserted into a non-combustible aerosol provision device such as the device 100 described with reference to FIGS. 3 to 7B. At least a portion of the mouthpiece 2 of the article 1 protrudes from the non-combustible aerosol provision device 100 and can be placed into a user's mouth. An aerosol is produced by heating the aerosol generating material 3 using the device 100. The aerosol produced by the aerosol generating material 3 passes through the mouthpiece 2 to the user's mouth.

Table 1.0 below shows the temperature of the outer surface of the article 1 as described with reference to FIG. 1 herein when heated using the device 100 described with reference to FIGS. 3 to 7B herein. In this example, the axial length of the body of material 6 is 20 mm, and the length of the tubular portion 4*a* is 21 mm.

First, second and third temperature measuring probes were used as corresponding first, second and third positions along the mouthpiece 2 of the article 1. The first position (numbered as position 1 in table 1.0) was at 4 mm from the downstream end 2*b* of the mouthpiece 2, the second position (numbered as position 2 in table 1.0) was at 8 mm from the downstream end 2*b* of the mouthpiece 2, and the third position (numbered as position 3 in table 1.0) was at 12 mm from the downstream end 2*b* of the mouthpiece 2.

The first position was therefore on the outer surface of the part of the mouthpiece 2, axially downstream of the first and second capsules 11A, 11B, while the second and third positions were on the outer surface of the part of the mouthpiece 2 at axial locations between the first and second capsules 11A, 11B.

Testing was performed for the first 9 puffs on the article, using standard testing equipment at a 60% relative humidity at 22 degrees Celsius environmental conditions.

TABLE 1.0

| Probe Pos. | Puff 1 | Puff 2 | Puff 3 | Puff 4 | Puff 5 | Puff 6 | Puff 7 | Puff 8 | Puff 9 |
|---|---|---|---|---|---|---|---|---|---|
| 1 | 44 | 49.1 | 49.1 | 48.9 | 46.3 | 43.9 | 42 | 39.8 | 38 |
| 2 | 45.5 | 50.6 | 50.3 | 50.1 | 47.8 | 45.6 | 44 | 42.1 | 40.8 |
| 3 | 51.8 | 56.4 | 55 | 55.1 | 53.2 | 51.6 | 49.7 | 48.6 | 46.8 |

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A non-combustible aerosol provision system, comprising:

an aerosol modifying component, an aerosol generating material and a heater configured to heat the aerosol generating material, wherein the aerosol modifying component is disposed downstream of the aerosol generating material and comprises a first capsule in a first portion of the aerosol modifying component and a second capsule in a second portion of the aerosol modifying component located downstream of the first portion and disposed downstream of the heater, wherein the heater is configured to heat the first portion of the aerosol modifying component to a first temperature to generate the aerosol;

wherein the heater is configured to heat the second portion to a second temperature to generate the aerosol, and wherein the second temperature is at least 4 degrees Celsius lower than the first temperature.

2. A non-combustible aerosol provision system according to claim 1, wherein the second temperature is at least 5 degrees Celsius lower than the first temperature.

3. A non-combustible aerosol provision system according to claim 1, wherein the first and/or second capsule has a diameter in the range of 1 to 5 mm.

4. A non-combustible aerosol provision system according to claim 1, wherein the first and second capsules are spaced apart by a distance of at least 7 mm.

5. A non-combustible aerosol provision system according claim 1, wherein the first and/or second capsule is disposed in a fibrous material.

6. A non-combustible aerosol provision system according claim 5, wherein the density of material is in the range of 0.1 to 0.2 gms/cm3.

7. A non-combustible aerosol provision system according to claim 1, wherein the first and second capsules are aerosol-modifying agent capsules having different aerosol-modifying profiles.

8. A non-combustible aerosol provision system according to claim 7, wherein the first and second capsules comprise different aerosol-modifying agents and/or a different amounts of an aerosol-modifying agent.

9. A non combustible aerosol provision system according to claim 7, wherein the second capsule comprises an aerosol-modifying agent that has a higher vapour pressure than the aerosol-modifying agent of the first capsule.

10. A non-combustible aerosol provision system according to claim 1, wherein the first and second capsules are aerosol-modifying agent capsules having the same aerosol-modifying profiles.

11. A non-combustible aerosol provision system according to claim 1, wherein the aerosol modifying component comprises a body of material and wherein the first and second capsules are located in the body of material.

12. A non-combustible aerosol provision system according to claim 11, wherein the body of material comprises a tow.

13. A non-combustible aerosol provision system according to claim 12, wherein the tow of the body of material has a weight of at most 100 mg.

14. A non-combustible aerosol provision system according to claim 12, wherein the average weight of the tow of the of the body of material per mm axial length of the body of material is at least 1 mg/mm and/or is at most 5 mg/mm.

15. A non-combustible aerosol provision system according to claim 12, wherein the body of material has an axial length in the range of 10 to 30 mm.

16. A non-combustible aerosol provision system according claim 1, wherein the pressure drop across the aerosol modifying component when the first and second capsules are unbroken is at least 15 mmH2O.

17. A non-combustible aerosol provision system according to claim 1, wherein the aerosol generating material is wrapped by a wrapper having a level of permeability greater than about 2000 Coresta Units, and wherein the article comprises a downstream portion downstream of the aerosol generating material, comprising at least one ventilation area.

18. A non-combustible aerosol provision system according to claim 1, wherein the article is configured such that when the article is inserted into a non-combustible aerosol provision device, the minimum distance between a heater of the non-combustible aerosol provision device and a tubular section of the article is at least about 3 mm.

19. A non-combustible aerosol provision system according to claim 1, wherein the level of ventilation provided by said one or more ventilation holes is within the range of 45% to 75% of the volume of aerosol passing through the component, or between 40% and 70% of the volume of aerosol passing through the component, or between 60% and 70%.

20. A non-combustible aerosol provision system according to claim 1, wherein the first temperature is between 58 and 70 degrees Centigrade.

* * * * *